US007624469B2

(12) United States Patent
Specht et al.

(10) Patent No.: US 7,624,469 B2
(45) Date of Patent: Dec. 1, 2009

(54) CLEANING IMPLEMENT

(75) Inventors: Paul B. Specht, Wilmette, IL (US); Paul M. Lesley, Chicago, IL (US); David A. McKnight, Hinsdale, IL (US)

(73) Assignee: Freudenberg Household Products, Northlake, IL (US)

( * ) Notice: Subject to any disclaimer, the term of this patent is extended or adjusted under 35 U.S.C. 154(b) by 135 days.

(21) Appl. No.: 10/755,726

(22) Filed: Jan. 12, 2004

(65) Prior Publication Data

US 2005/0150069 A1 Jul. 14, 2005

Related U.S. Application Data

(60) Provisional application No. 60/439,246, filed on Jan. 10, 2003.

(51) Int. Cl.
*A47L 13/144* (2006.01)

(52) U.S. Cl. ..... 15/119.2; 15/116.2; 15/118; 15/115

(58) Field of Classification Search ..... 15/116.2, 15/115, 118, 119.2
See application file for complete search history.

(56) References Cited

U.S. PATENT DOCUMENTS

| | | | | |
|---|---|---|---|---|
| 2,756,449 | A | 7/1956 | Dewey | |
| 3,783,469 | A * | 1/1974 | Siemund | 15/209.1 |
| 4,491,998 | A | 1/1985 | Wilson et al. | |
| 4,604,767 | A * | 8/1986 | Burkhart et al. | 15/119.2 |
| 4,654,920 | A | 4/1987 | O'Neil, Jr. et al. | |
| 5,097,561 | A | 3/1992 | Torres | |
| RE35,005 | E | 8/1995 | Torres | |
| 5,511,276 | A * | 4/1996 | Lee | 15/167.1 |
| 5,599,550 | A * | 2/1997 | Kohlruss et al. | 424/404 |
| 5,609,255 | A | 3/1997 | Nichols | |
| 5,933,904 | A | 8/1999 | De Guzman | |
| 5,996,161 | A * | 12/1999 | Facca | 15/120.1 |
| 6,055,696 | A | 5/2000 | Lin | |
| 6,141,813 | A * | 11/2000 | De Guzman | 15/119.2 |
| 6,148,465 | A | 11/2000 | Hsieh et al. | |
| 6,178,581 | B1 | 1/2001 | Lewis | |
| RE37,415 | E * | 10/2001 | Petner | 15/119.2 |
| 6,785,927 | B2 * | 9/2004 | Lesley et al. | 15/119.1 |
| 2002/0029433 | A1 | 3/2002 | Libman | |
| 2002/0100494 | A1 * | 8/2002 | Brown et al. | 134/6 |
| 2005/0028309 | A1 * | 2/2005 | Boyer et al. | 15/119.2 |

FOREIGN PATENT DOCUMENTS

| | | |
|---|---|---|
| DE | 100 03 899 C1 | 9/2001 |
| DE | 202 16 253 U1 | 12/2002 |
| FR | 69395 | 11/1958 |

* cited by examiner

*Primary Examiner*—Shay L Karls
(74) *Attorney, Agent, or Firm*—Leydig, Voit & Mayer, Ltd.

(57) ABSTRACT

Disclosed is a cleaning implement, preferably in the form of a roller mop, that includes a mop head, a shaft, and a wringer. The cleaning implement further includes a connecting link connected to the mop head and to the shaft or wringer. The mop head has a connecting side and a cleaning side thereby defining a mop axis, which axis is disposed at an oblique angle with respect to the longitudinal axis of the shaft. At least a portion of the connecting link is disposed with the shaft. The mop head can include a scrubber attachment. Also inventive is the disclosed mechanism by which the scrubber attachment connects to the head of the mop. Various embodiments of mop heads can be used with the invention. A cleaning cloth can be mounted to the mop head.

41 Claims, 22 Drawing Sheets

CLEANING IMPLEMENT

CROSS-REFERENCE TO RELATED PATENT APPLICATIONS

This patent application claims the benefit of U.S. Provisional Patent Application No. 60/439,246, filed Jan. 10, 2003, and entitled, "Cleaning Implement," the entire contents of which are incorporated herein by this reference.

FIELD OF THE INVENTION

The invention is in the field of cleaning implements. In the preferred embodiments, the invention is directed toward a roller mop that includes a sponge-type mop head and a scrubber brush.

BACKGROUND OF THE INVENTION

Numerous cleaning implements for applying and removing liquid to and from a floor have been provided in the prior art. One well-known type of such cleaning implement is a roller mop, which generally comprises a mop head made of a natural or synthetic sponge material connected to the end of a shaft. Roller mops further include a wringer, which typically comprises a pair of rollers and an actuating mechanism. The rollers may be either affixed to the shaft or movable with respect thereto such that the rollers and the mop head typically are movable with respect to each other over a range of travel between a cleaning position and wringing positions. In the cleaning position, the cleaning implement may be used to apply liquid to a surface, such as, a wall or floor, or to remove liquid therefrom, and in the wringing positions, liquid is expellable from the mop head.

In addition, roller mops with scrubber attachments have long been known in the art. The use of an electrostatic cloth for cleaning is also known in the art.

The prior art has provided numerous straight head and angle head roller mops, an "angle head" roller mop being one in which the mop head is disposed at an oblique angle with respect to a longitudinal axis of the shaft. Of the two types, straight head mop heads generally are less convenient for cleaning in that the operator generally is most comfortable positioning the shaft of the cleaning implement at an oblique angle with respect to the floor. It is believed that angle head mops heads are more satisfactory for applying or removing liquid from a floor. However, it has been observed that many prior art angle head roller mop wringing mechanisms are not entirely satisfactory. It is desired to improve the cleaning functionality of the mop.

It is a general object of the invention to provide a cleaning implement. In some embodiments, it is a general object of the invention to provide a cleaning implement that includes a scrubber attachment. In some embodiments, it is a general object of the invention to provide a cleaning implement that includes an electrostatic dust cloth.

SUMMARY OF THE INVENTION

In accordance with the invention, a cleaning implement having a shaft, a mop head, and a wringing mechanism is provided. The mop head can be disposed at an oblique angle with respect to the longitudinal axis of the shaft. The cleaning implement further includes a connecting link operatively connected to the operator gripping portion of the wringing mechanism and to one of the mop head and the wringing mechanism. At least a portion of the connecting link is disposed within the shaft. The connecting link may be fashioned in numerous ways. A scrubber brush attachment can be removably mounted to a channel body of the wringing mechanism via a connecting track. In another aspect of the invention, an electrostatic dust cloth can be removably mounted to the cleaning implement by disposing one or more edge portions of the dust cloth between a roller of the wringing mechanism and the mop head, for example. In yet another aspect of the invention, the mop head can include a liquid-absorbent member having a layer of reticulated material. In yet other embodiments, the mop head can have a cleaning surface that includes a plurality of voids such that the surface area of the voids is at least 15 percent of the total surface area of the cleaning surface.

Features of the present invention will become apparent to one of ordinary skill in the art upon reading the detailed description, in conjunction with the accompanying drawings, provided herein.

BRIEF DESCRIPTION OF THE DRAWINGS

In these descriptions, the terms "top," "bottom," and the like are for convenient reference only and should not be construed as limiting because in practice the cleaning implement may be oriented omnidirectionally.

DETAILED DESCRIPTION OF EMBODIMENTS OF THE INVENTION

Figure 1:
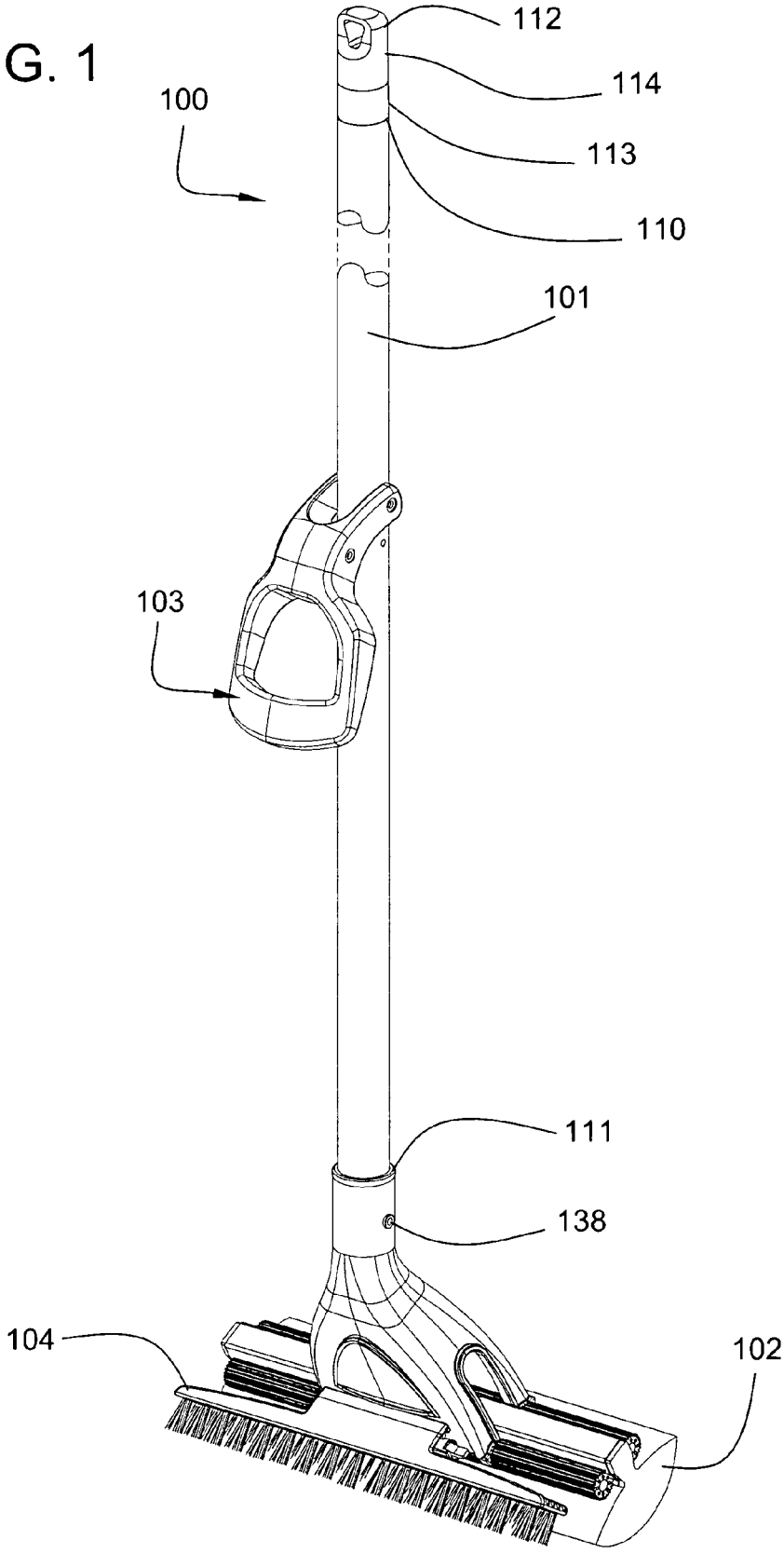
FIG. 1 is a perspective view of an embodiment of a cleaning implement according to the present invention.
Figure 2:
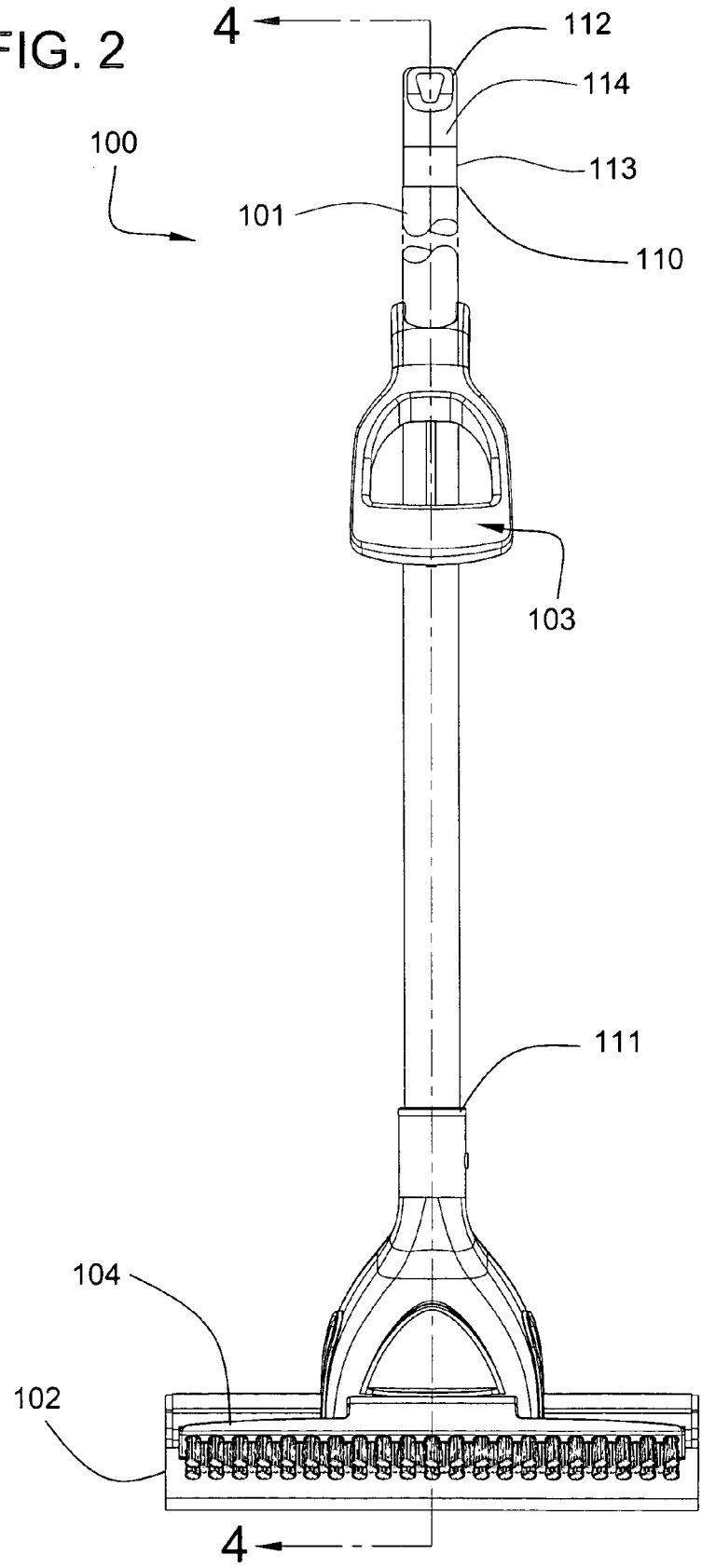
FIG. 2 is a front elevational view of the cleaning implement of FIG. 1.

Referring to FIGS. 1-6, an embodiment of a cleaning implement 100 according to the present invention is shown. Referring to FIGS. 1 and 2, the cleaning implement 100 generally includes a shaft 101, a mop head 102, a wringing mechanism 103, and a scrubber attachment 104. The wringing mechanism is operable to selectively move the mop head 102 over a range of travel between a cleaning position, as shown in FIGS. 1 and 2, and a range of wringing positions wherein liquid is expellable from the mop head. The wringing mechanism 103 is mounted to the shaft 101. The mop head 102 is mounted to the wringing mechanism. The scrubber attachment 104 is removably mounted to the wringing mechanism. In other embodiments, the scrubber attachment 104 can be mounted to other components of the cleaning implement 100.

The shaft 101 is hollow and includes an operator end 110 and a cleaning end 111. A hanger cap 112 can be disposed at the operator end 110 of the shaft 101. The hanger cap 112 in the illustrated embodiment is a two-part cap in which one part 113 is fixed with respect to the shaft 101 and the other part 114 is rotatable with respect thereto.

Figure 3:
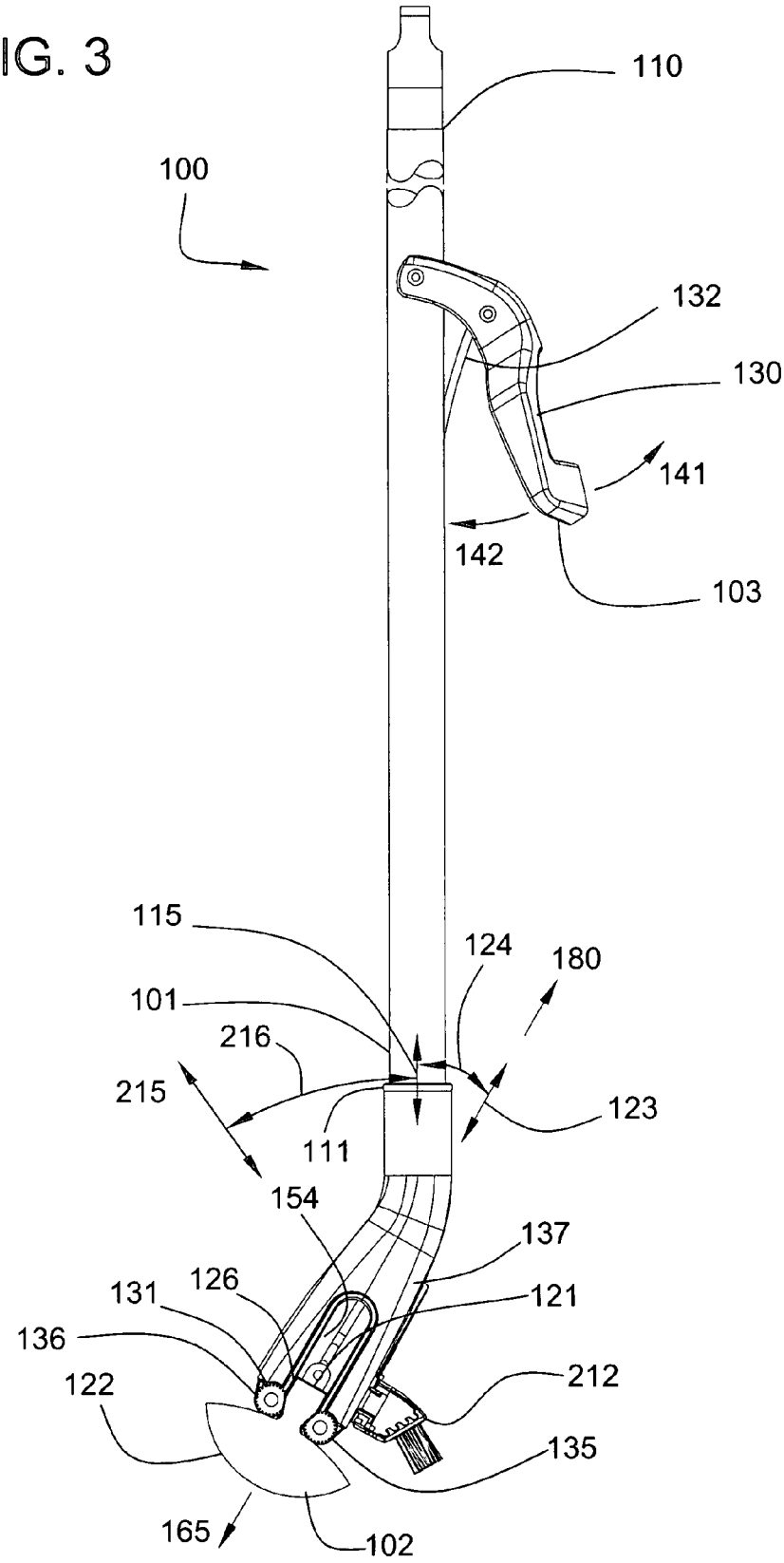
FIG. 3 is a side elevational view of the cleaning implement of FIG. 1.

Referring to FIG. 3, the operator end 110 and the cleaning end 111 of the shaft 101 define a longitudinal axis 115. Generally, the mop head 102 includes a connecting side 121 and a cleaning side 122 which define a mop head axis 123, as shown in FIG. 3. The mop head axis 123 is disposed at an oblique angle 124 with respect to the longitudinal axis 115 of the shaft.

The mop head 102 is composed of a liquid absorbent material, which preferably is a synthetic sponge material. The mop head 102 further includes a retainer clip 126, which "pinches" the liquid absorbent material to thereby form the mop head. The mop head 102 of the cleaning implement 100 can be substantially similar to the mop head shown and described in U.S. Pat. No. Re. 35,005 to Torres, reissued Aug. 1, 1995, which is incorporated herein by reference in its entirety.

Figure 4:
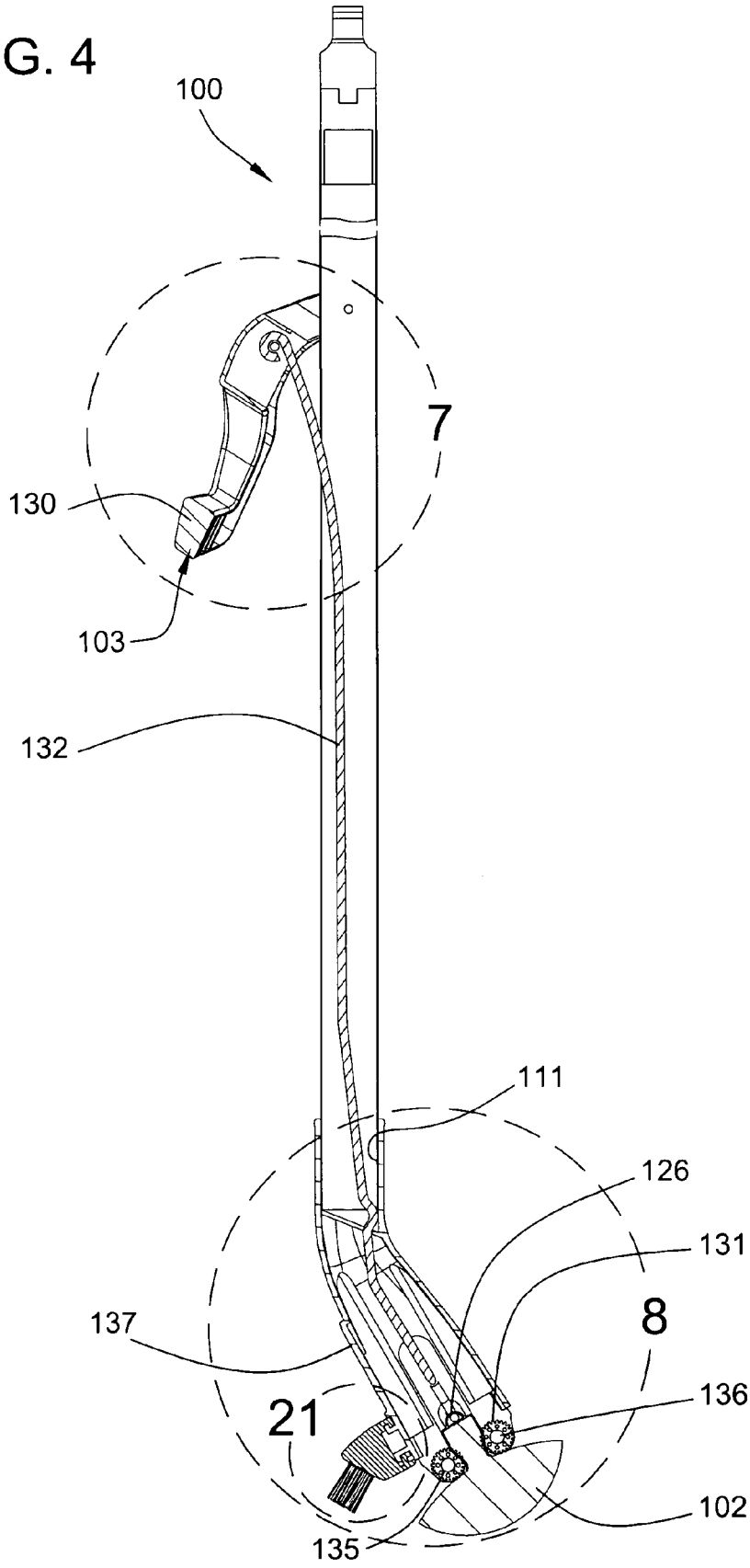
FIG. 4 is a cross-sectional view of the cleaning implement of FIG. 1 taken along line 4-4 in FIG. 2.
Figure 5:
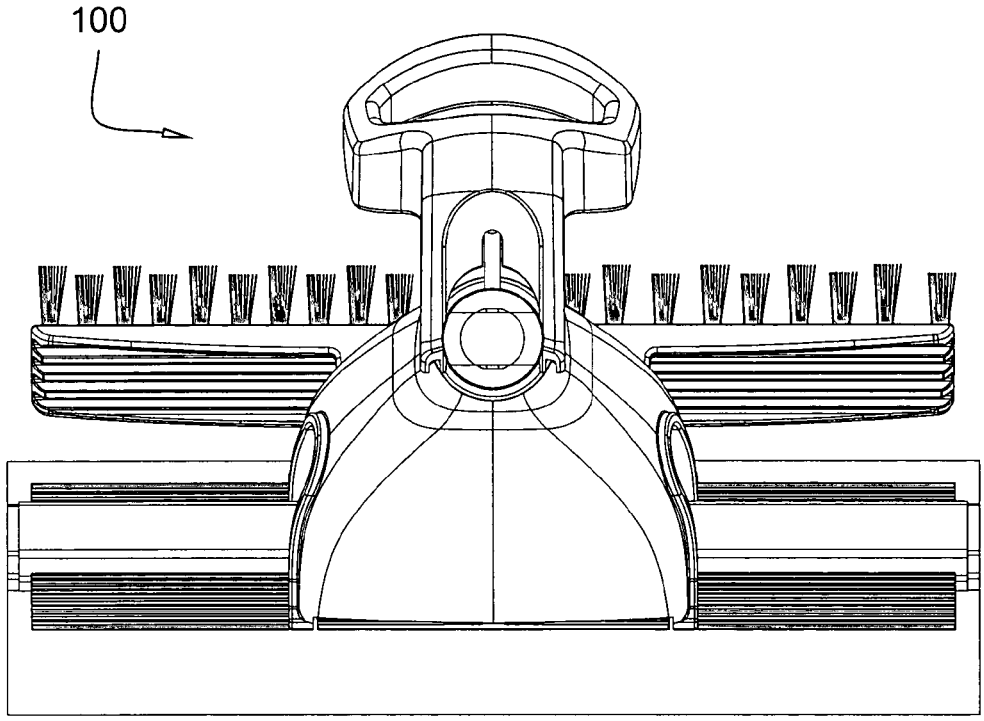
FIG. 5 is a top plan view of the cleaning implement of FIG. 1.
Figure 6:
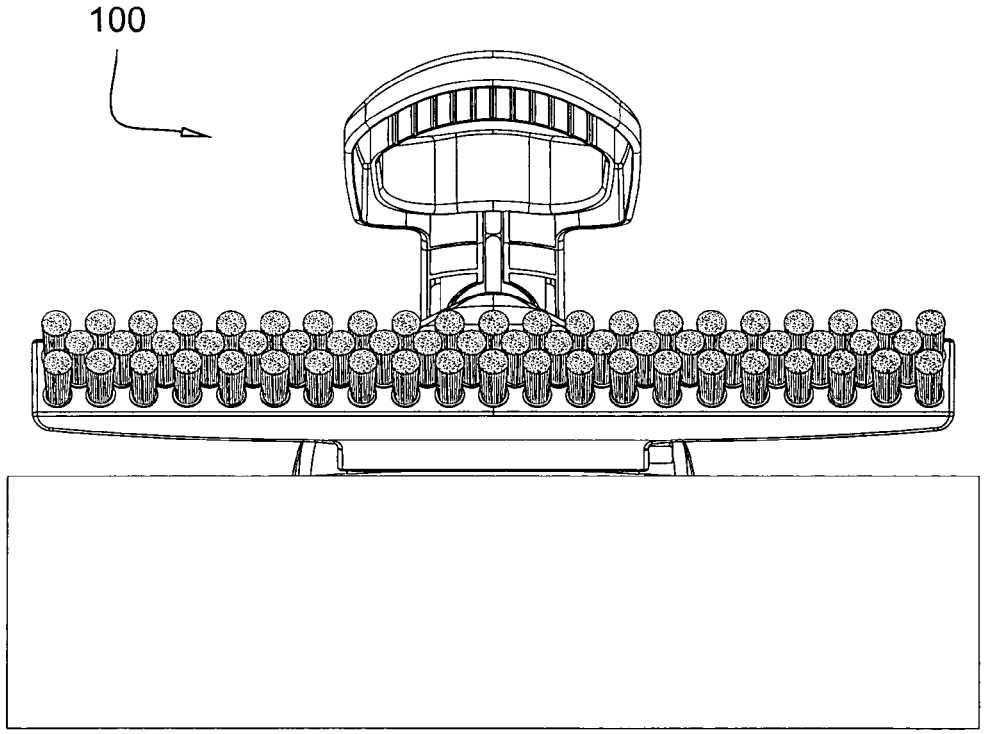
FIG. 6 is a bottom plan view of the cleaning implement of FIG. 1.

Referring to FIGS. 3 and 4, the wringing mechanism 103 can include an operator gripping portion 130, a wringer 131, and an actuator 132. In the illustrated embodiment, the operator gripping portion 130 is configured as a gripping handle, and the wringing portion 131 is configured as a pair of rollers 135, 136 journaled to a channel body 137. The channel body 137 can be mounted to the cleaning end 111 of the shaft via a rivet 138 (see FIG. 1), for example, or any other suitable device or technique. The actuator 132 can be connected to the operator gripping portion 130 and one of the mop head 102 and the wringer 131. In the illustrated embodiment, the actuator 132 is connected between the gripping handle 130 and the mop head 102. The actuator 132 is configured as a connecting link, which is a rigid member connected to the gripping handle 130 and the retainer clip 126.

Figure 7:
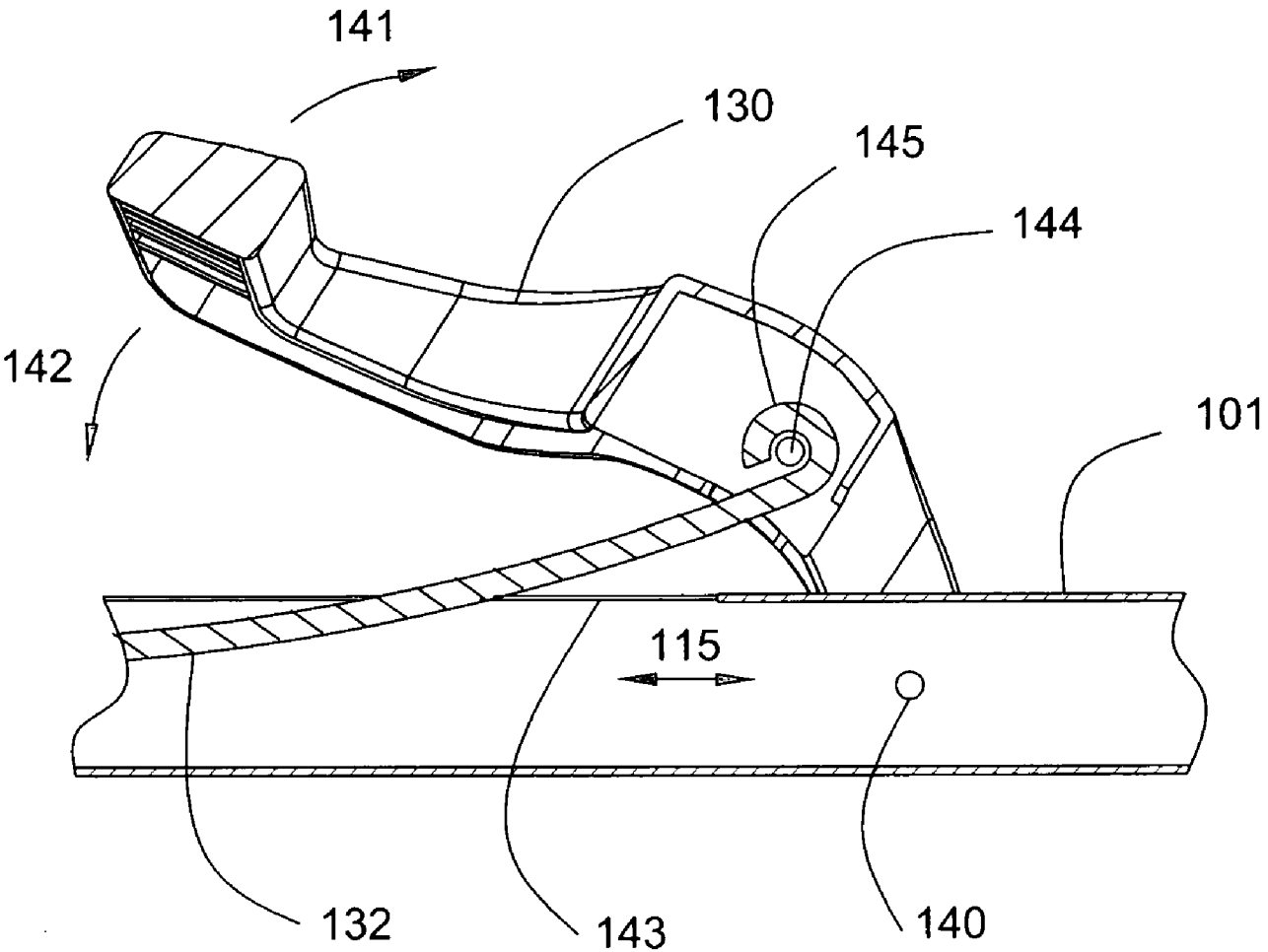
FIG. 7 is an enlarged detail view taken from FIG. 4 of an operator gripping portion of a wringing mechanism of the cleaning implement of FIG. 1.

Referring to FIG. 7, the gripping handle 130 can be pivotally mounted to the shaft 101 via a staked pivot pin 140 or other suitable device. The gripping handle 130 is pivotable about the pivot pin 140 in a retracting direction 141 for wringing the mop head and an extending direction 142 for moving the mop head away from the rollers to allow for convenient replacement of the mop head.

The connecting link 132 is pivotally mounted to the gripping handle 130. The shaft 101 can include a slot 143 for allowing the connecting link 132 to extend into the hollow shaft 101. The connecting link 132 can be mounted to the gripping handle 130 via a connector pin 144 staked to the gripping handle 130 and extending through an eyelet 145 disposed at the end of the connecting link 132. The eyelet and pin arrangement operably arranges the connecting link 132 and the gripping handle 130 such that the connecting link is urged to move along the longitudinal axis 115 of the shaft 101 in response to pivotal movement of the gripping handle 130 in either the retracting direction 141 or the extending direction 142 while allowing the connecting link to pivot with respect to the gripping handle. In other embodiments, the connecting link can be mounted to the gripping handle using other known devices or techniques.

Figure 8:
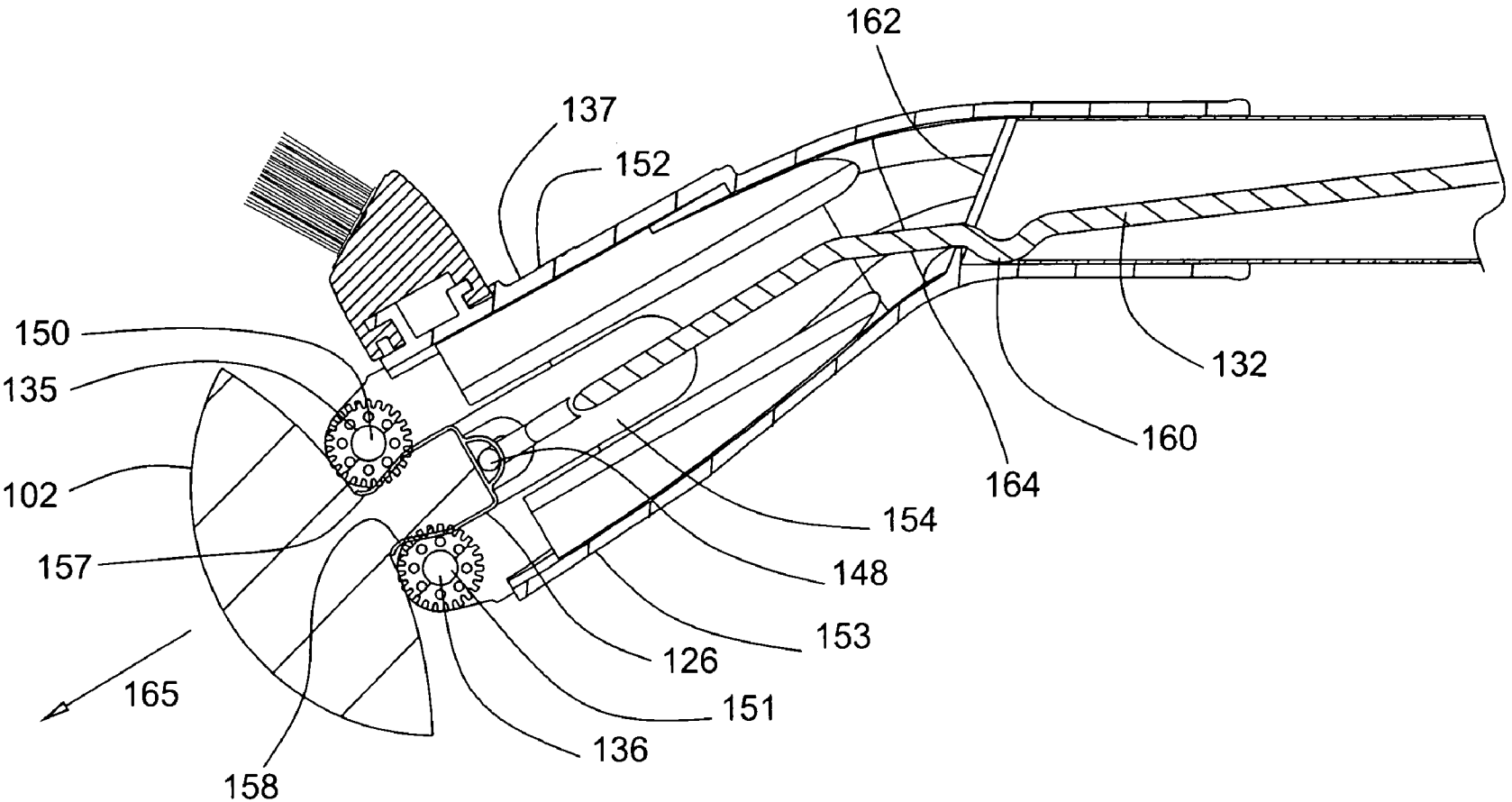
FIG. 8 is an enlarged detail view taken from FIG. 4 of a wringer of the wringing mechanism, having rollers and a channel body, and a mop head of the cleaning implement of FIG. 1.

Referring to FIG. 8, the connecting link 132 can be connected to the mop head 102 via the retainer clip 126. The retainer clip 126 of the mop head 102 is configured to receive a connecting link having a threaded end or a hook-type connecting link. The mop head 102 thus may be regarded as a "universal" mop head fitting various types of mops. The connecting link 132 can have a hooked end 148 (see also FIG. 11) for retentive engagement with the retainer clip 126. Alternatively, the connecting link 126 can be connected to the mop head 102 via screw threads received by a threaded portion of the mop head 102. The threaded portion may protrude slightly from the surrounding portion of the retainer clip 126, for example, as a result of forming the threaded portion.

The rollers 135, 136 are journaled to the channel body 137 for rotational movement thereof. The rollers 135, 136 are respectively disposed in first and second pairs of bearings 150, 151 which are in turn disposed in first and second arms 152, 153 of the channel body 137. The channel body 137 is hollow. The arms 152, 153 define a channel 154 into which the mop head 102 can move during a wringing sequence. The arms 152, 153 are spaced with respect to each other to define a yoke-like bearing for the wringer rollers 135, 136 such that the rollers 135, 136 are separated a predetermined distance from each other.

Each roller can comprise a plurality of roller portions through which an axle extends. The roller portions can include axial serrations around their surfaces to increase the gripping purchase of each roller upon the mop head during a wringing operation. The multiple roller portion construction can facilitate mounting the roller to the bearings of the channel body. In other embodiments, one or both of the rollers can include a single roller portion. The bearings of the channel body can be configured to retentively engage the roller in a known fashion.

The rollers 135, 136 rest in recesses 157, 158, respectively, defined by curved portions of the retainer clip 126 of the mop head 102, thereby inhibiting relative axial movement of the rollers 135, 136 and the mop head 102. The connecting link 132 includes a bent segment 160 which is disposed adjacent to a wall 162 of the channel body 137 when the mop head 102 is in the cleaning position, as shown in FIG. 8. The connecting link 132 extends through an opening 164 in the wall 162 with the bent segment 160 disposed near the opening 164. The opening 164 is configured to be smaller than the bent segment 160 but to allow the bent segment 162 to pass therethrough upon sufficient application of force to the gripping handle in the extending direction. The opening and bent segment arrangement can further inhibit relative axial movement of the mop head 102 and the rollers 135, 136 in a mop head extending direction 165.

Figure 9:
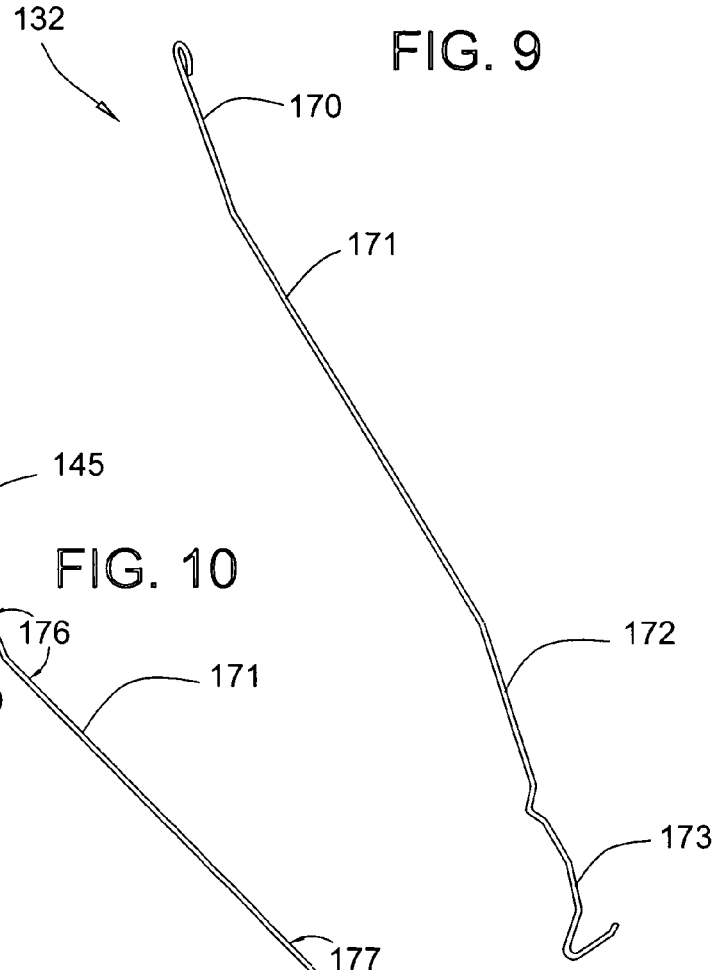
FIG. 9 is a perspective view of a connecting link of the wringing mechanism of the cleaning implement of FIG. 1.
Figure 10:
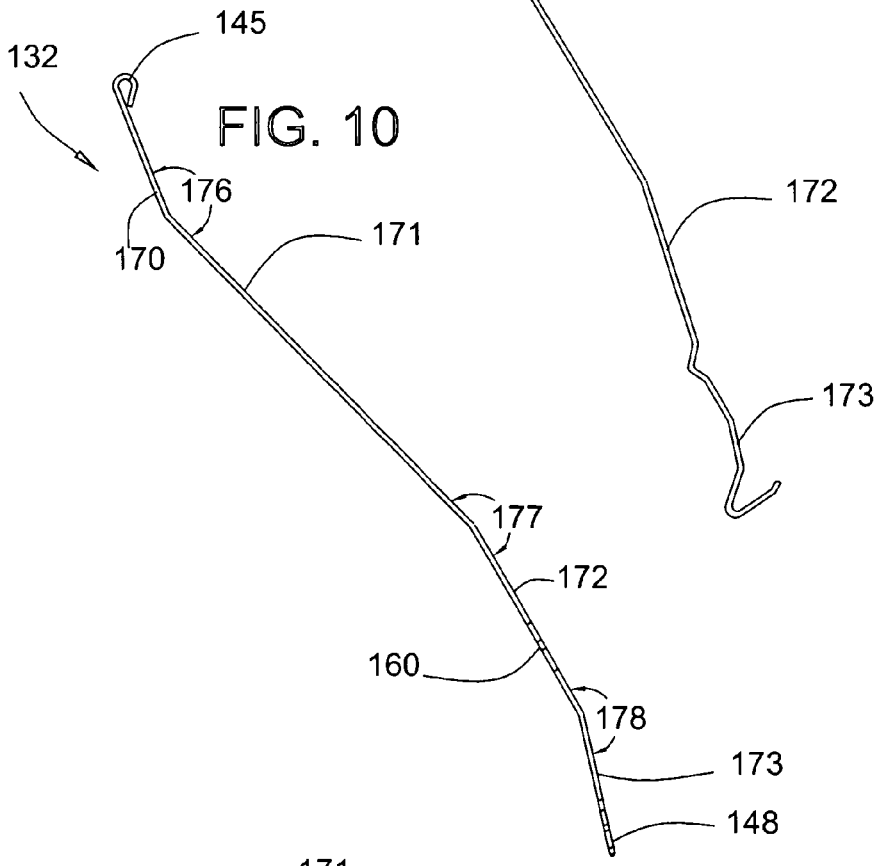
FIG. 10 is a side elevational view of the connecting link of FIG. 9.
Figure 11:
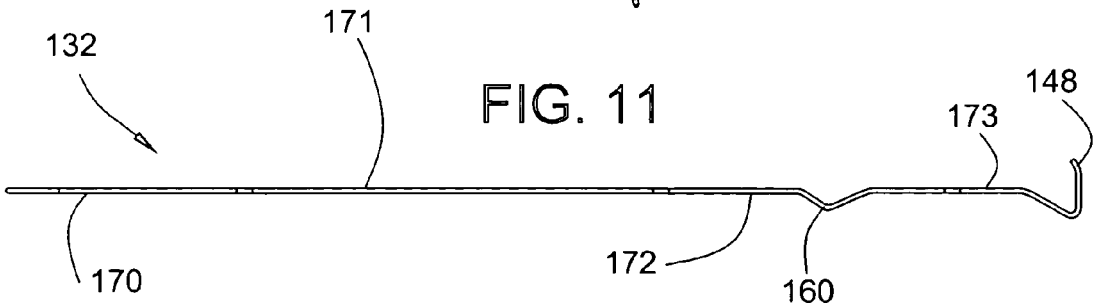
FIG. 11 is a front elevational view of the connecting link of FIG. 9.

Referring to FIGS. 9-11, the connecting link 132 includes a connector portion 170, a first and a second central portion 171, 172 and a head portion 173. Referring to FIG. 10, the connector portion 170 includes the eyelet 145 and can be disposed at a first angle 176 with respect to the first central portion 171. The first central portion 171 can be disposed at a second angle 177 with respect to the second central portion 172. The second central portion 172 can include the bent segment 160 and can be disposed at a third angle 178 with respect to the head portion 173. The head portion 173 can include the hooked end 148. In other embodiments, the hooked end can be omitted and a threaded portion can be present.

The wringer mechanism 103 can be similar in other respects to the one shown and described in U.S. Pat. No. 5,097,561 to Torres, the entire contents of which are incorporated herein by this reference.

Referring to FIG. 3, the mop head 102 is shown in the cleaning position. Generally, the mop head 102 is wrung by gripping the shaft 101 and the operator gripping handle 130 of the wringing mechanism 103 and by manually moving the handle 130 with respect to the shaft 101 in the retracting direction 141. In response, the connecting link 132 moves, thereby causing the mop head 102 to move substantially in a mop head retraction direction 180 along the mop head axis 123 to move the mop head through wringing positions wherein the mop head 102 is compressed between the rollers 135, 136 to thereby expel liquid from the mop head. As the mop head 102 is retracted, the connecting link 132 moves in a complex path, thus causing the mop head 102 to be retracted into the channel 154 of the wringer along a path substantially coextensive with the mop axis 123 for at least a portion of the range of travel.

When it is desired to change or replace the mop head, the mop head can be moved from the cleaning position into an overextended position by moving the operator gripping handle 130 in the extending direction 142. In response, the connecting link 132 will urge the mop head 102 to move in the mop head extending direction 165 away from the rollers.

Referring to FIGS. 12-15, the channel body 137 can include a connecting end 182 configured to be mounted to the cleaning end of the shaft and a wringing end 183 for supporting the rollers and defining the channel into which the mop head can move during a wringing operation. The channel body 137 can include an elbow portion 184 which can facilitate the placement of the mop head such that the mop head axis is in non-parallel relationship with respect to the longitudinal axis of the shaft.

Figure 13:
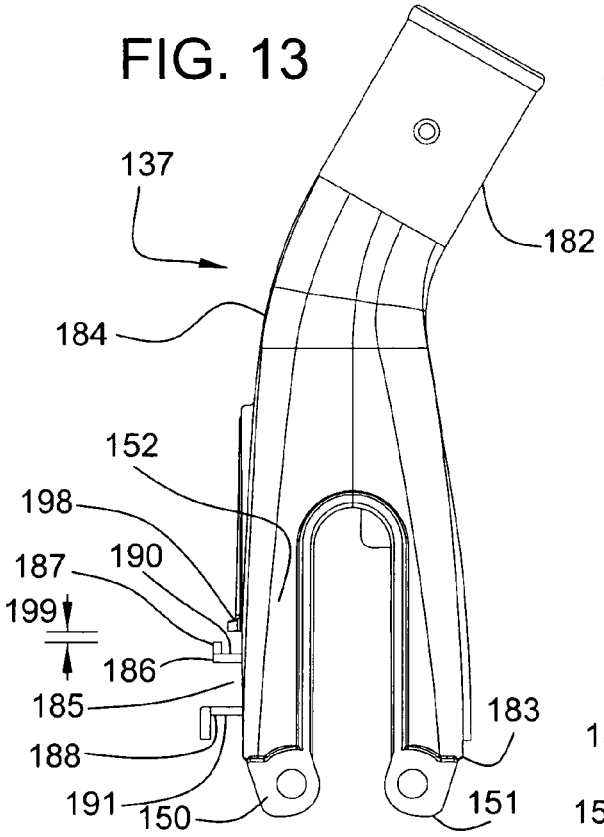
FIG. 13 is a first side elevational view of the channel body of FIG. 12.
Figure 14:
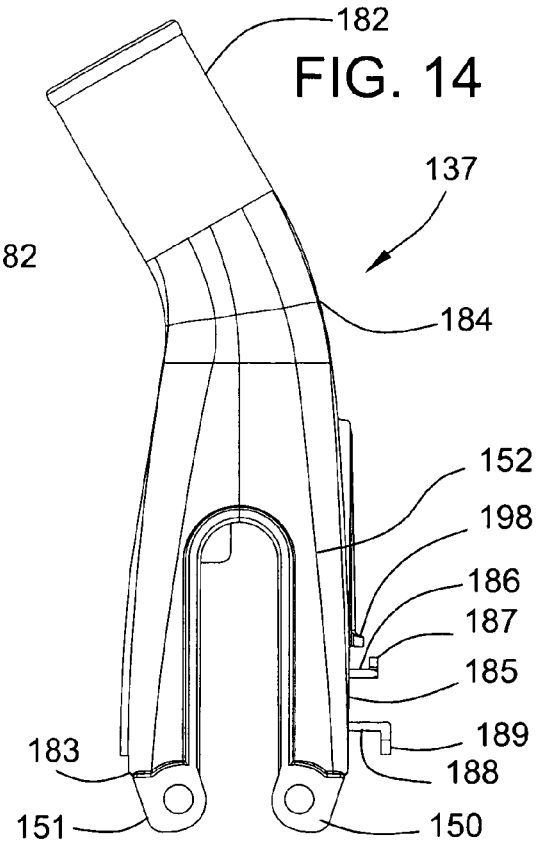
FIG. 14 is a second side elevational view of the channel body of FIG. 12.

The channel body can include a track 185 for supporting the scrubber attachment. The track 185 can include a first rail 186, with a first flange 187 projecting toward the connecting end 182 of the channel body 137, and a second rail 188, with a second flange 189 extending toward the roller bearings 150 of the first arm 150 of the channel body 137. The first and second flanges 187, 189 cooperate with the first arm 152 to define first and second grooves 190, 191, respectively, therebetween. Referring to FIGS. 13 and 14, the first and second flanges 187, 189 can be in offset relationship with each other such that the flanges are not aligned with each other.

Figure 12:
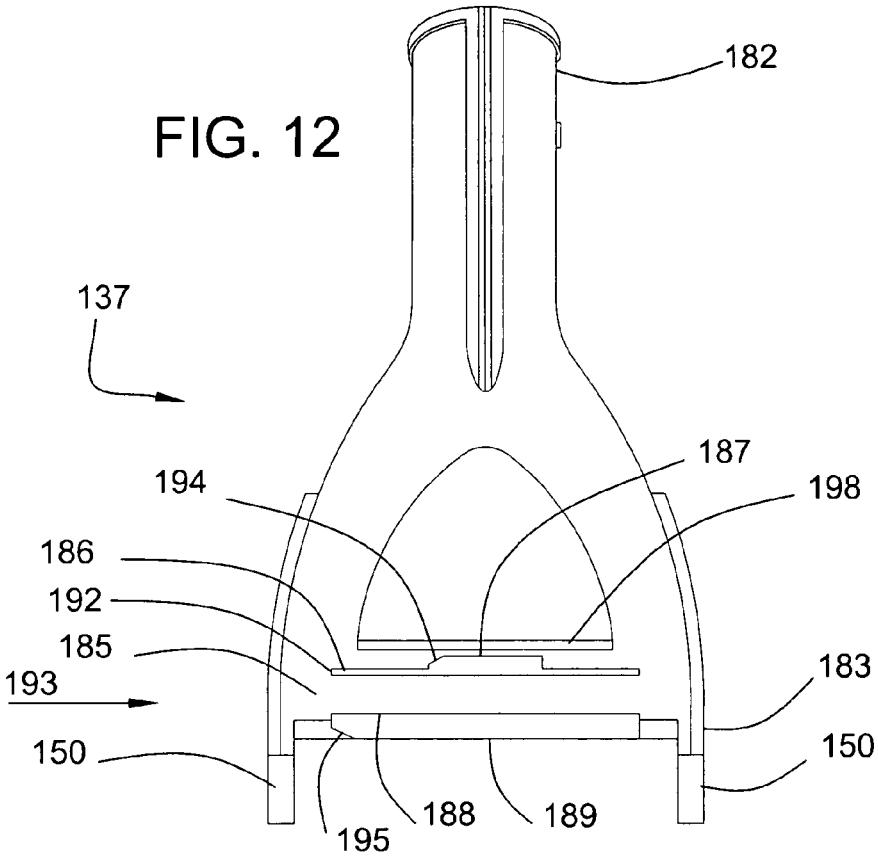
FIG. 12 is a front elevational view of a channel body of the cleaning implement of FIG. 1.

Referring to FIG. 12, the track 185 includes an opening end 192 at which the scrubber attachment can be inserted onto the track by moving in a mounting direction 193. The first and second flanges 187, 189 each include a beveled end 194, 195, respectively. The beveled ends 194, 195 can be configured such that they facilitate the alignment of the scrubber attachment with the track 185 when the scrubber is moved in the mounting direction 193.

The channel body 137 can include a ridge 198 projecting therefrom and disposed in predetermined, spaced relationship with respect to the first rail 186. Referring to FIG. 13, the ridge 198 and the flange 187 of the first rail 186 are disposed with respect to each other such that there is a clearance 199 defined therebetween. The clearance 199 can be configured to accommodate a portion of a runner of the scrubber attachment therethrough.

Figure 15:
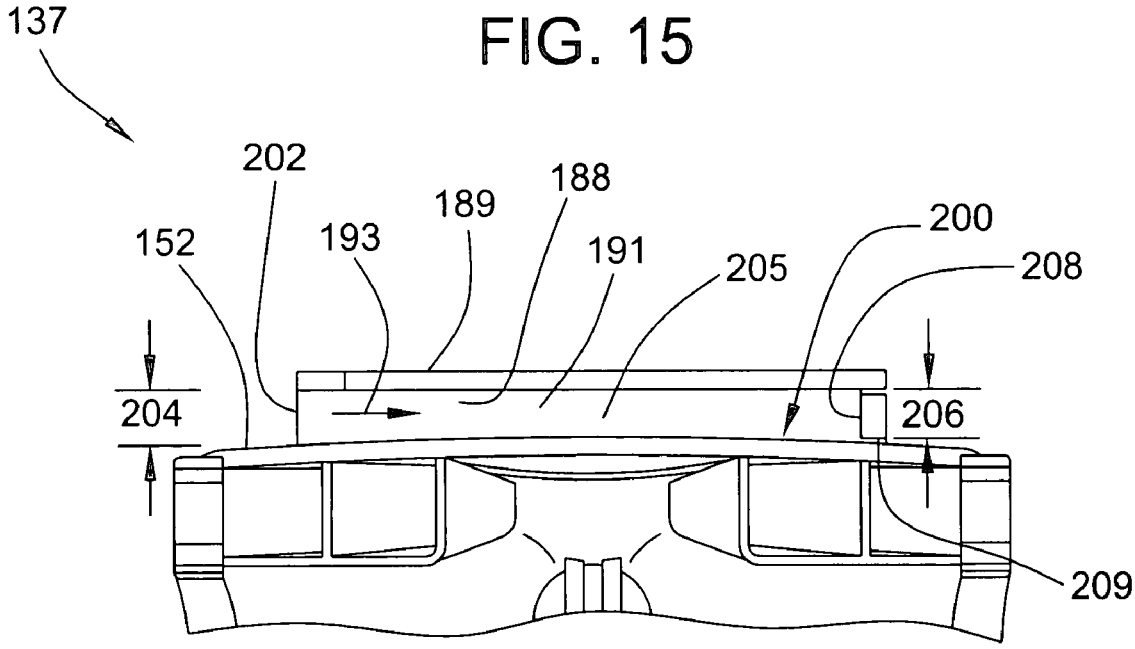
FIG. 15 is a fragmentary bottom plan view of the channel body of FIG. 12.

Referring to FIG. 15, the first arm 152 of the channel body 137 can include a curved outer surface 200 that curves away from the second flange 189 of the second rail 188 such that an opening 202 of the second groove 191 is a first distance 204 and a central portion 205 of the second groove 191 is a second distance 206 with the second distance 206 being smaller than the first distance 204. The second distance 206 can be configured to closely conform to the portion of a runner of the scrubber which is disposed in the central portion 205 when the scrubber attachment is mounted to the track. The narrowing of the second groove 191 at the central portion 205 from a relatively larger opening 202 can facilitate the mounting of the scrubber attachment to the track in that the scrubber can be connected to the track by moving in the mounting direction 193 into the opening 202 where the relatively greater distance 204 can make it easier to align the scrubber with the second groove 191. The second rail 188 can include a notch 208 at the end 209 opposite the opening 202 to accommodate a flexible retaining finger of the scrubber attachment for removably mounting the scrubber to the track.

Referring to FIGS. 16-20, the scrubber attachment 104 is shown. The scrubber 104 can include a connecting side 210

Figure 16:
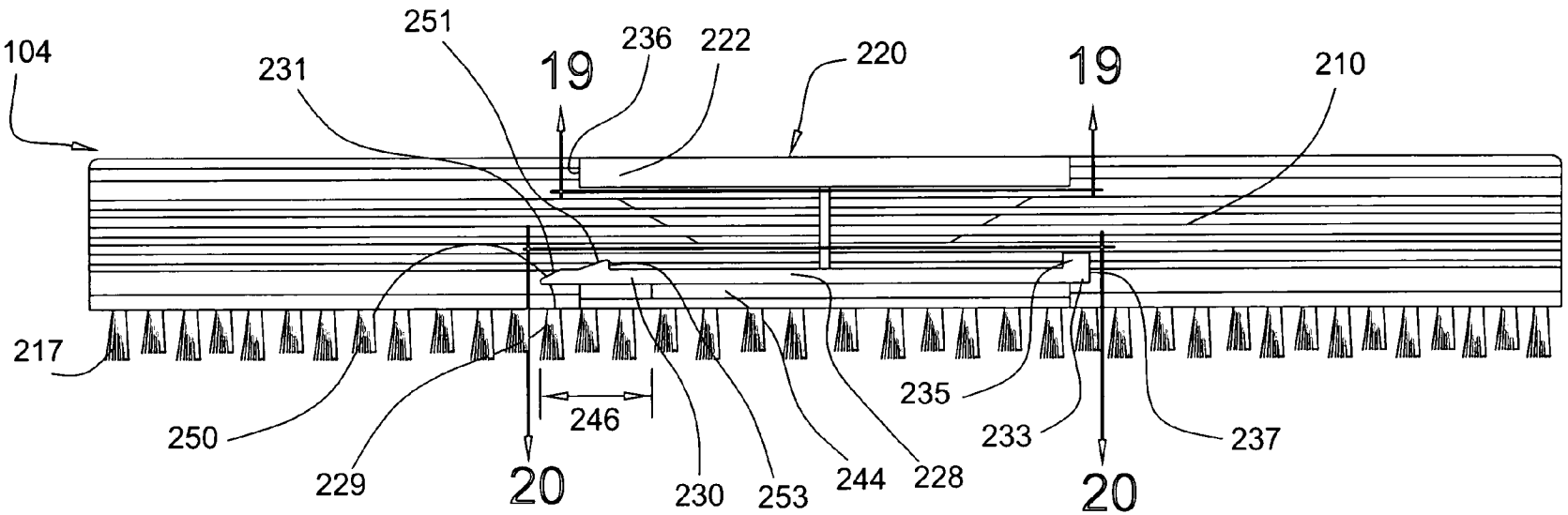
FIG. 16 is a plan view of a connecting side of a scrubber attachment of the cleaning implement of FIG. 1.
Figure 18:
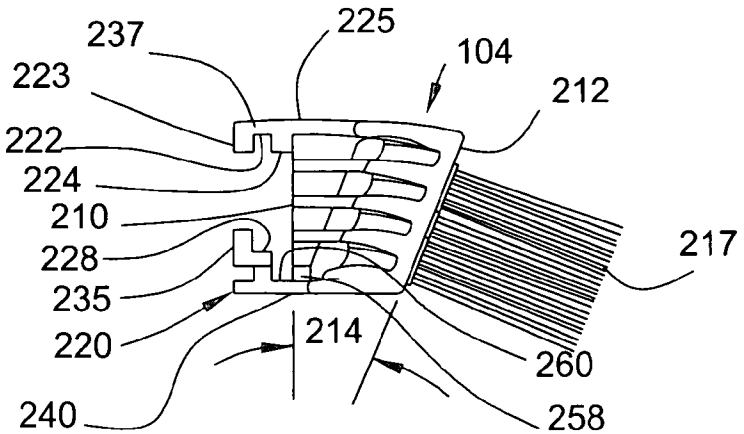
FIG. 18 is a second side elevational view of the scrubber attachment of FIG. 16.
Figure 17:
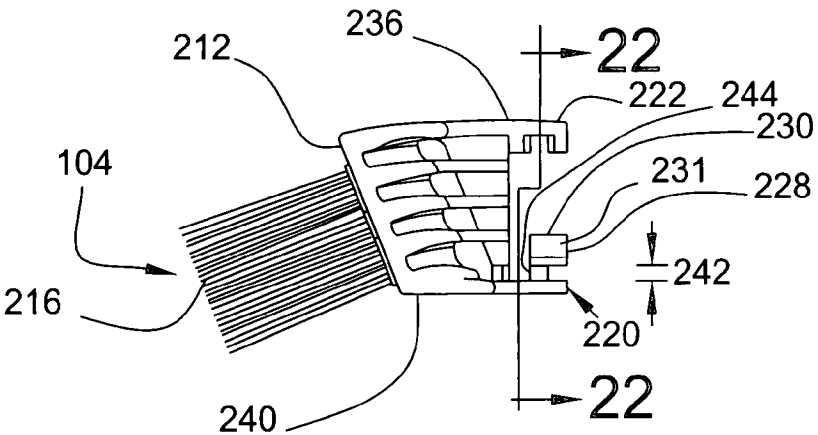
FIG. 17 is a first side elevational view of the scrubber attachment of FIG. 16.

(see FIG. 16) and a cleaning side 212 (see FIG. 17). As shown in FIG. 18, the connecting and cleaning sides 210, 212 can respectively define substantially planar surfaces which are in non-parallel relationship with each other such that they are disposed at a predetermined angle 214 with respect to each other.

Referring to FIG. 3, the angled relationship of the sides of the scrubber attachment 104 allows for the plane of the cleaning side 212 of the scrubber 104 to be disposed at a predetermined angle with respect to the longitudinal axis 115 of the shaft 101 for convenient use of the scrubber 104 to clean surfaces, for example, such that, when the scrubber 104 is mounted to the cleaning implement 100, a scrubber axis 215, which is perpendicular to the plane of the cleaning side 212 thereof, is disposed at a predetermined oblique angle 216 with respect to the longitudinal axis 115 of the shaft. In some embodiments, the angle 216 between the longitudinal axis 115 of the shaft and the scrubber axis 215 can be substantially the same as the angle 124 between the longitudinal axis 115 of the shaft and the mop head axis 123.

Referring to FIGS. 16-18, the cleaning side 212 of the scrubber attachment 104 can include a plurality of bristles 217 mounted to a substrate. The bristles 217 can be arranged in an array of groups. The bristles can be attached to the cleaning side 212 by any suitable technique, such as, through fusion bonding, for example, sometimes practiced as fusion shot-bonding. In accordance with this technique, the bristles can be bunched and "shot" onto the scrubber attachment substrate at an elevated temperature to form a grouping of bristles upon cooling. The scrubber attachment substrate may be composed of a thermoplastic material and may be heated prior to shooting the bristles onto it. In other embodiments, the scrubber attachment can include an abrasive material that is abrasive relative to the liquid absorbent material of the mop head. The scrubber attachment may be removable or non-removable in ordinary use.

Referring to FIGS. 16-20, the scrubber brush attachment 104 can include a mounting mechanism 220 for removably mounting the scrubber 104 to the cleaning implement. In the illustrated embodiment, the mounting mechanism 220 can be removably mounted to the track 185 of the channel body 137, as shown in FIG. 21. Referring to FIGS. 16-20, the mounting mechanism can include a first runner 222 defined by a pair of projecting ribs 223, 224 extending from a first wall 225 and a second runner 228 having at one end 229 a resiliently flexible retaining finger 230 which has a terminal barbed portion 231 and at the other end 233 a stop 235. The first and second runners 222, 228 can be in spaced relationship with respect to each other and configured such that they can be slidingly moved in only the mounting direction along the track 185 and can retentively engage the track, as shown in FIG. 21.

The first and second runners 222, 228 can have an asymmetrical configuration with respect to each other such that the mounting mechanism 220 has a polarity. The mounting mechanism 220 can correspond to the track. The mounting mechanism 220 can include a leading end 236 (shown in FIG. 17) and a trailing end 237 (shown in FIG. 18). The leading end 236 can be configured such that it can be inserted into the opening of the track to mount the scrubber thereto but that it cannot be inserted into the other end of the track. The trailing end 237 can be configured such that it cannot be inserted into either the opening of the track or the other end thereof such that the scrubber 104 can be mounted to the track in only one orientation and in one direction.

Figure 19:
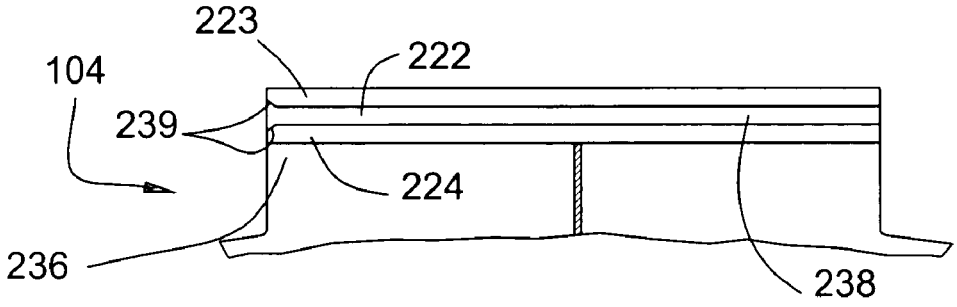
FIG. 19 is a fragmentary cross-sectional view of the scrubber attachment of FIG. 16 taken along line 19-19 in FIG. 16.

Referring to FIG. 19, the ribs 223, 224 of the first runner 222 are in spaced relationship with each other to define a first retaining groove 238 therebetween. The retaining groove 238 of the first runner 222 of the scrubber 104 can be configured to accommodate the flange 187 of the first rail 186 of the channel body 137, as shown in FIG. 21, to aid in the retentive engagement of the scrubber 104 to the track 185. Referring to FIG. 19, the ribs 223, 224 of the first runner 222 each includes a beveled end 239 at the leading end 236 which can facilitate the mounting of the scrubber upon the track of the channel body.

Referring to FIG. 17, the second runner 228 is disposed in spaced relationship with a second wall 240 of the scrubber 104 a predetermined distance 242 toward the first runner 222 to allow the retaining finger 230 to be resiliently movable. The second runner is connected to the second wall 240 via a support rib 244. Referring to FIG. 16, the second runner 228 is connected to the second wall 240 via the support rib 243 such that the retaining finger 230 extends a predetermined distance 246 from the support rib 244. The barbed portion 231 of the retaining finger 230 can include a terminal beveled surface 250, a second beveled surface 251, and a shoulder 253.

Figure 20:
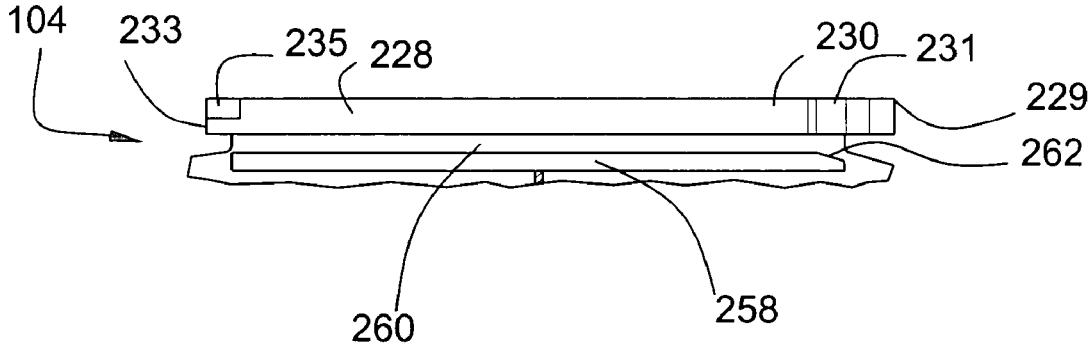
FIG. 20 is a fragmentary cross-sectional view of the scrubber attachment of FIG. 16 taken along line 20-20 in FIG. 16.
Figure 21:
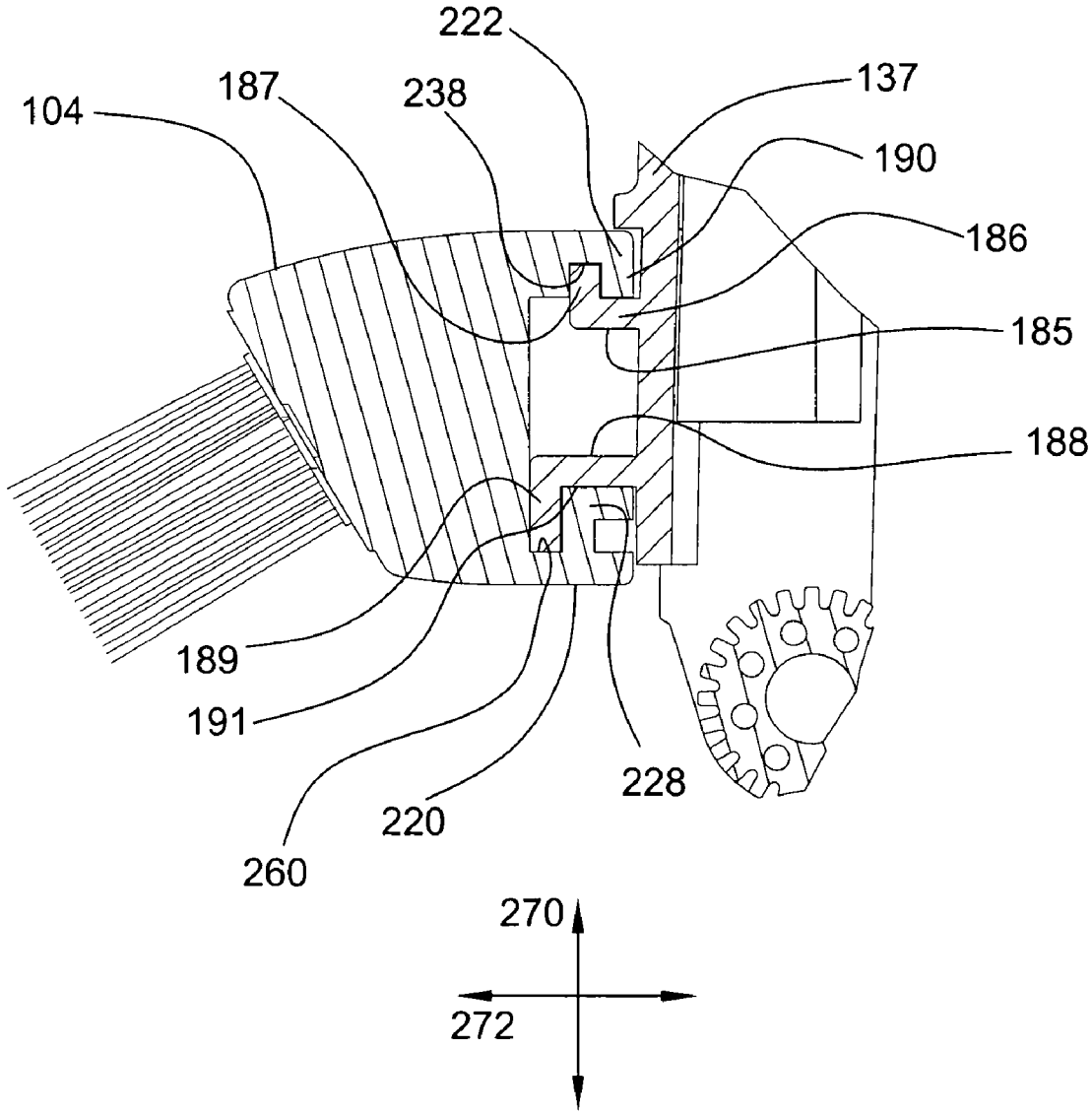
FIG. 21 is an enlarged detail view taken from FIG. 4 of the scrubber attachment mounted to the channel body.

Referring to FIGS. 18 and 20, the second runner 228 and the support rib 244 cooperate with a guide rib 258 to define a second retaining groove 260 therebetween. Referring to FIG. 18, the second retaining groove 260 can be in offset relationship with respect to the first retaining groove 224 such that the retaining grooves are not aligned. The first and second retaining grooves 224, 260 can be configured such that they correspond with the first and second flanges of the track of the channel body when the scrubber is oriented in a predetermined manner.

Referring to FIG. 20, the guide rib 258 can have a beveled end 262 at the leading end 236 which can facilitate the mounting of the scrubber upon the track of the channel body. The second runner 228 can be configured such that it closely conforms to the second groove 191 of the track 185, as shown in FIG. 21.

Referring to FIG. 21, the scrubber 104 is removably mounted to the track 185 of the channel body 137. The first and second runners 222, 228 can retentively engage the first and second rails 186, 188, respectively, such that the scrubber 104 is constrained from moving along a first axis 270 and a second axis 272 which is perpendicular to the first axis 270. The first and second axes 270, 272 are both perpendicular to the mounting direction. The first runner 222 of the scrubber attachment can extend along the first groove 190 of the track. The second runner 228 of the scrubber can extend along the second groove 191 of the track. The first rib 223 of the first runner 222 engages the first rail 186 and the second runner 228 engages the second rail 188 such that the first and second rails are captured between the first rib 223 and the second run 228, respectively, to constrain relative movement of the scrubber 104 and the track 185 along the first axis 270. The first flange 187 is disposed in the first retaining groove 238 of the scrubber, and the second flange 189 is disposed in the second retaining groove 260 to constrain relative movement of the scrubber 104 and the track 185 along the second axis 272. The retaining finger and barbed end of the second runner can engage the second rail 188 of the track to releasably retain the scrubber attachment 104 relative to the track 185.

Figure 22:
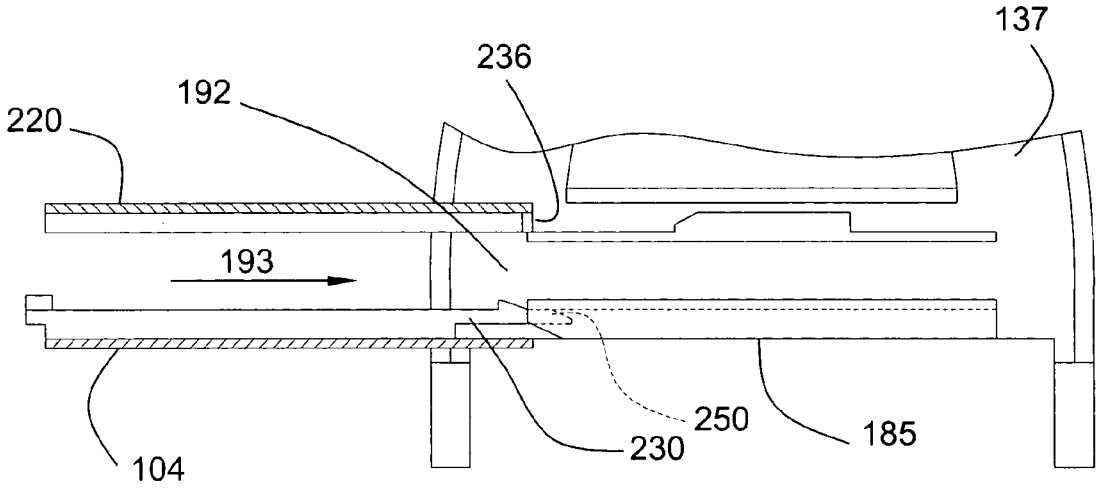
FIG. 22 is a fragmentary, front elevational view of the channel body of FIG. 12 and a cross-sectional view of the scrubber attachment of FIG. 16 taken along line 22-22 in FIG. 17, showing the scrubber attachment beginning a mounting sequence with respect to a track of the channel body.

Referring to FIGS. 22-25, a mounting sequence of the scrubber 104 to the track 185 of the channel body 137 is shown. Referring to FIG. 22, the leading end 236 of the scrubber 104 is disposed adjacent the opening 192 of the track 185. The terminal beveled end 250 of the retaining finger 230 extends from the leading end 236 and can be used to facilitate the alignment of the mounting mechanism 220 of the scrubber with the channel 185. Relative movement of the scrubber 104 in the mounting direction 193 with respect to the track 185 can allow the mounting mechanism of the scrubber to slide along the track.

Figure 23:
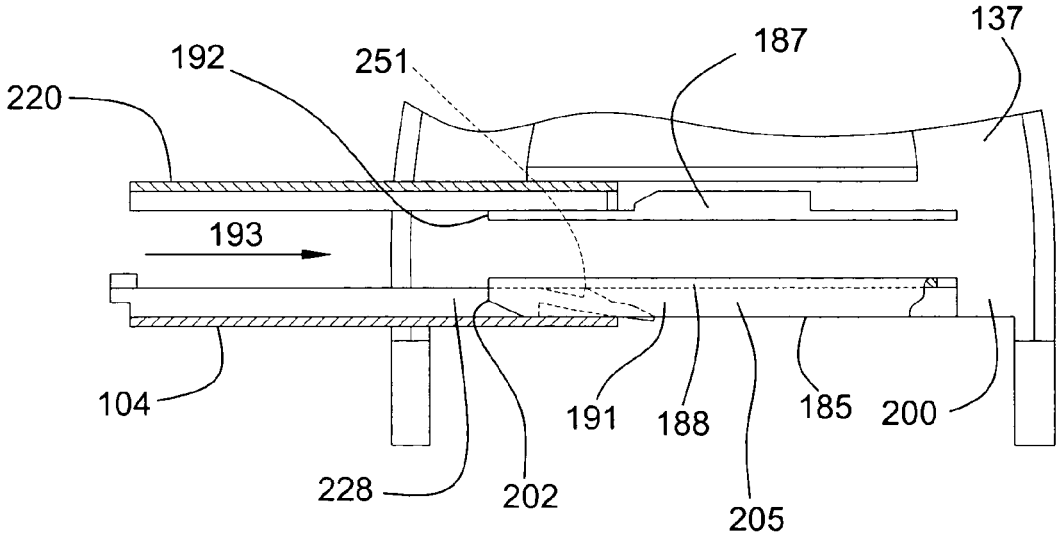
FIG. 23 is a view similar to FIG. 22, showing the scrubber attachment in a first intermediate mounting position wherein a second runner of the scrubber attachment is mounted to a second rail of the channel body.

Referring to FIG. 23, the scrubber 104 has been advanced in the mounting direction 193 with respect to its position in FIG. 22. The second runner 228 is retentively engaged with the second rail 188 of the track 185. The retaining finger 230 is flexed from its normal position in response to being inserted into the second groove 191. The second beveled surface 251 of the retaining finger 230 bears against the second rail 188. The second flange 189 and the curved outer surface 200 of the channel body retentively engage the second runner 228. As the mounting mechanism 220 advances in the mounting direction 193 relative to the track 185, it can be increasingly more difficult to advance the scrubber as the resilient finger moves from the relatively large opening 202 of the second groove toward the central portion 205 thereof.

By offsetting the first flange 187 from the opening, the scrubber initially can engage only the second rail 188, thereby easing the effort required of a user to align the scrubber with the track and to advance the scrubber in the mounting direction during an initial portion of the mounting sequence.

Figure 24:
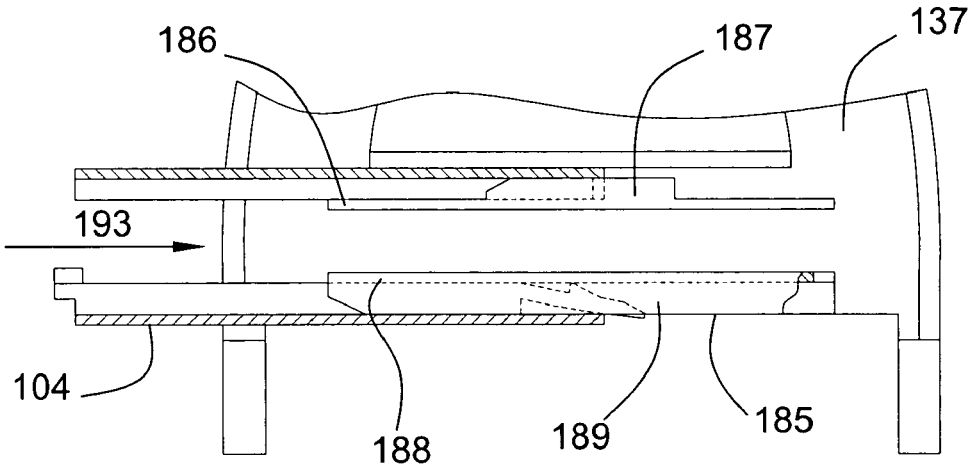
FIG. 24 is a view similar to FIG. 22, showing the scrubber attachment in a second, further intermediate mounting position wherein a first runner of the scrubber attachment is also mounted to a first rail of the channel body.

Referring to FIG. 24, the scrubber 104 is relatively more advance along the mounting direction 193 than shown in FIG. 23. The first runner 222 is engaged with the first rail 186 and accompanying flange 187. The second runner 228 is engage with the second rail 188 and accompanying flange 189.

Figure 25:
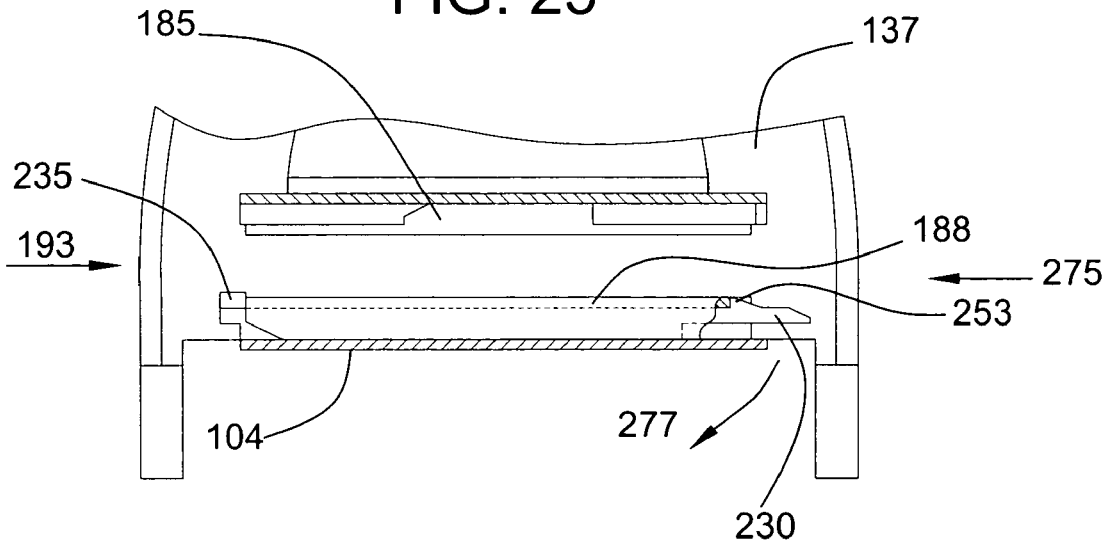
FIG. 25 is a view similar to FIG. 22, showing the scrubber attachment in a mounted position.

Referring to FIG. 25, the scrubber 104 is shown in a mounted position with respect to the track 185. The resilient finger 230 has returned to its normal position, being disposed in the notch 208 of the second rail 188. The second rail 188 is captured between the shoulder 253 of the resilient finger 230 and the stop 235. The stop 235 prevents the scrubber from moving further relative to the track 185 in the mounting direction 193. The shoulder 253 prevents movement of the scrubber in a removal direction 275 relative to the track. The stop prevents the stopped end of the scrubber attachment from being placed first on the track. The barbed and stopped ends thus define a "one-way" mounting feature such that the scrubber attachment can only be mounted to the track in the intended fashion.

When it is desired to remove the scrubber 104 from the channel body 137, a user can manually deflect the resilient finger in an outward direction 277 to disengage the shoulder 253 thereof from the second rail 188 to allow the scrubber 104 to be moved in the removal direction 275, opposite from the mounting direction 193.

Figure 26:
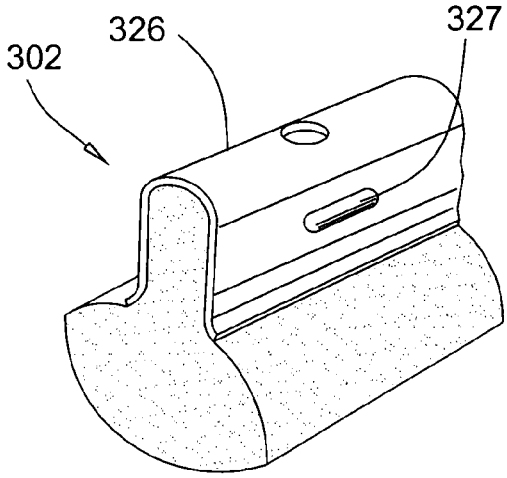
FIG. 26 is a perspective view of another embodiment of a mop head suitable for use with the present invention.
Figure 27:
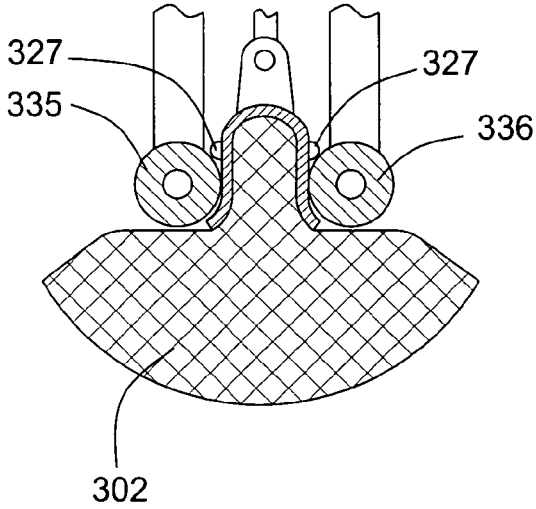
FIG. 27 is a side sectional view of the mop head of FIG. 26 shown disposed in a channel body suitable for use with the present invention.
Figure 28:
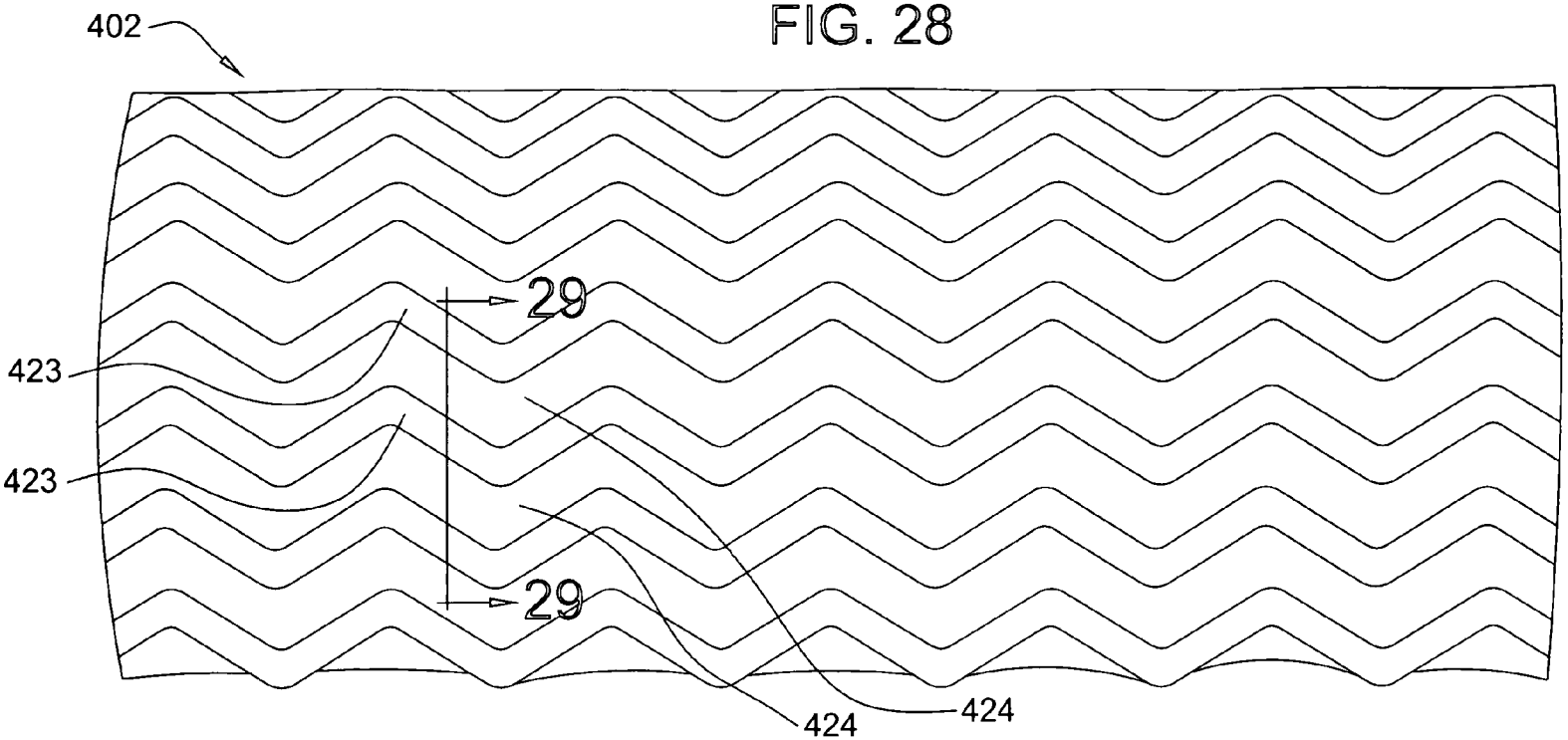
FIG. 28 is a plan view of a cleaning side of a mop head suitable for use with the present invention.
Figure 29:
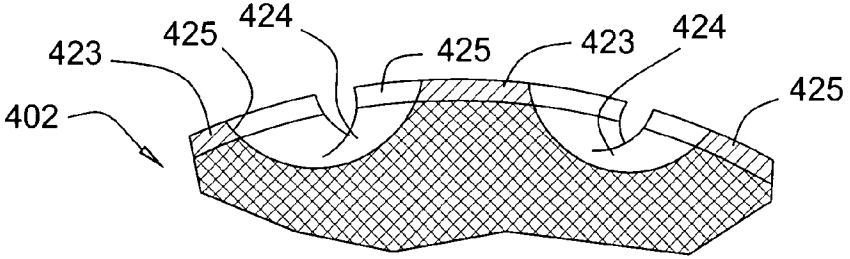
FIG. 29 is a fragmentary, cross-sectional view of the mop head of FIG. 28 taken along line 29-29 in FIG. 28.

Referring to FIGS. 26 and 27, an alternative embodiment of a mop head 302 is shown having a retainer clip 326. The retainer clip 326 may further include nubs 327 which protrude from the clip 326 and are intended to inhibit unintentional overextension of the mop head 102. With such an arrangement, the bent segment 160 of the connecting link 132 (see FIG. 11) can be omitted. Referring to FIG. 27, the rollers 335, 336 can be disposed between the nubs 327 and the bulk of the mop head 302 to help retain the mop head in the cleaning position Referring to FIGS. 28 and 29, another embodiment of a mop head 402 suitable for use with the present invention is shown. The mop head 402 includes a cleaning side 422 having a plurality of alternating lands 423 and valleys 424 defined therein. The lands 423 and valleys 424 give the cleaning side a striated appearance. Each land 423 and valley 424 can have a generally saw-toothed shape. Referring to FIG. 29, each land 423 can include an outer layer 425 of material that is different than the remainder of the material of the mop head sponge. Preferably, the layer 425 is made of a reticulated material, even more preferably made of an open-cell filter foam, and even more preferably is made from a Foamex Protecpaire polyether polyurethane foam thermally reticulated material made by Foamex International of Eddystone, Pa. In other embodiments, the outer layer of the lands can be made from a material that is more abrasive than the remainder of the material of the mop head sponge.

Figure 30:
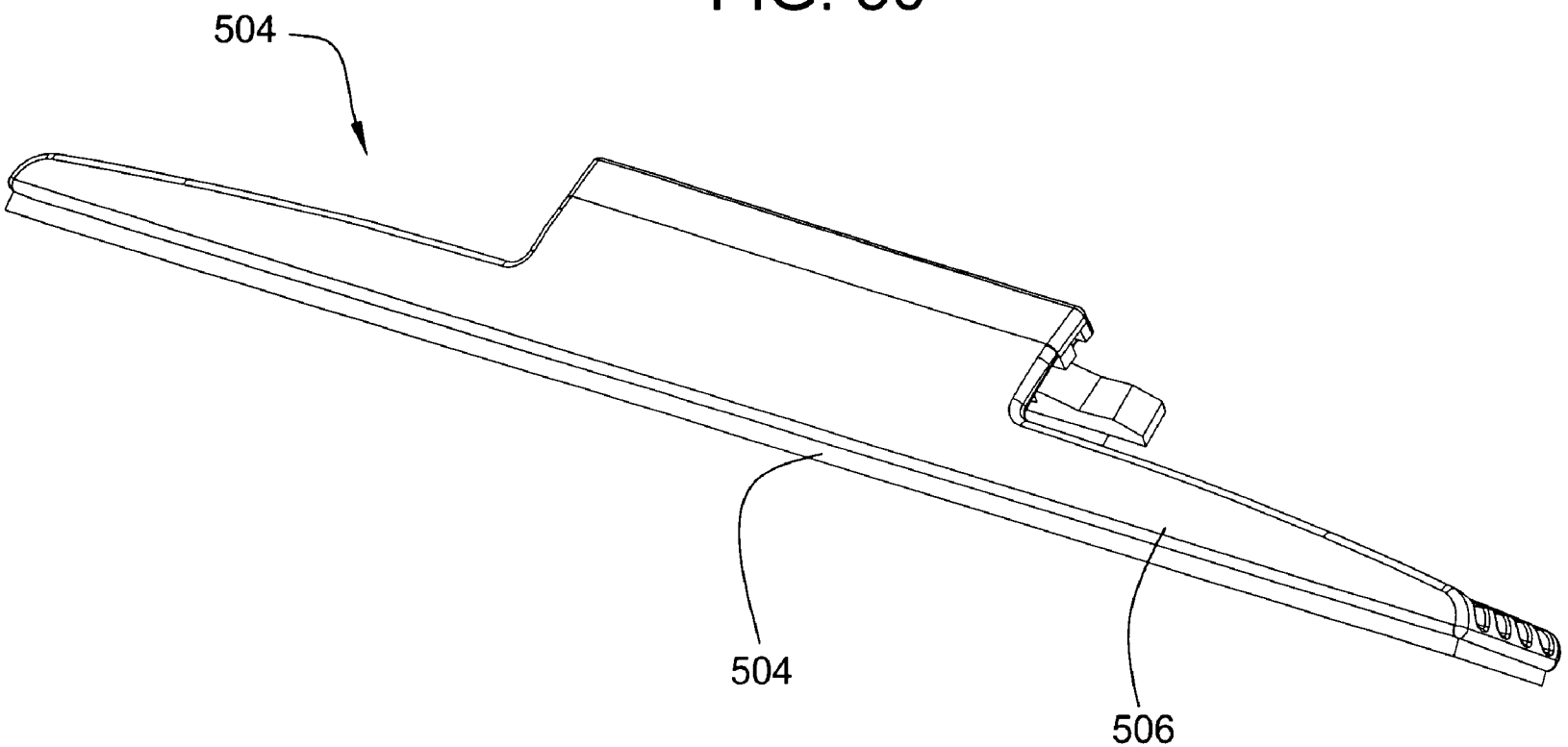
FIG. 30 is a perspective view of another embodiment of a scrubber attachment suitable for use with the present invention.
Figure 31:
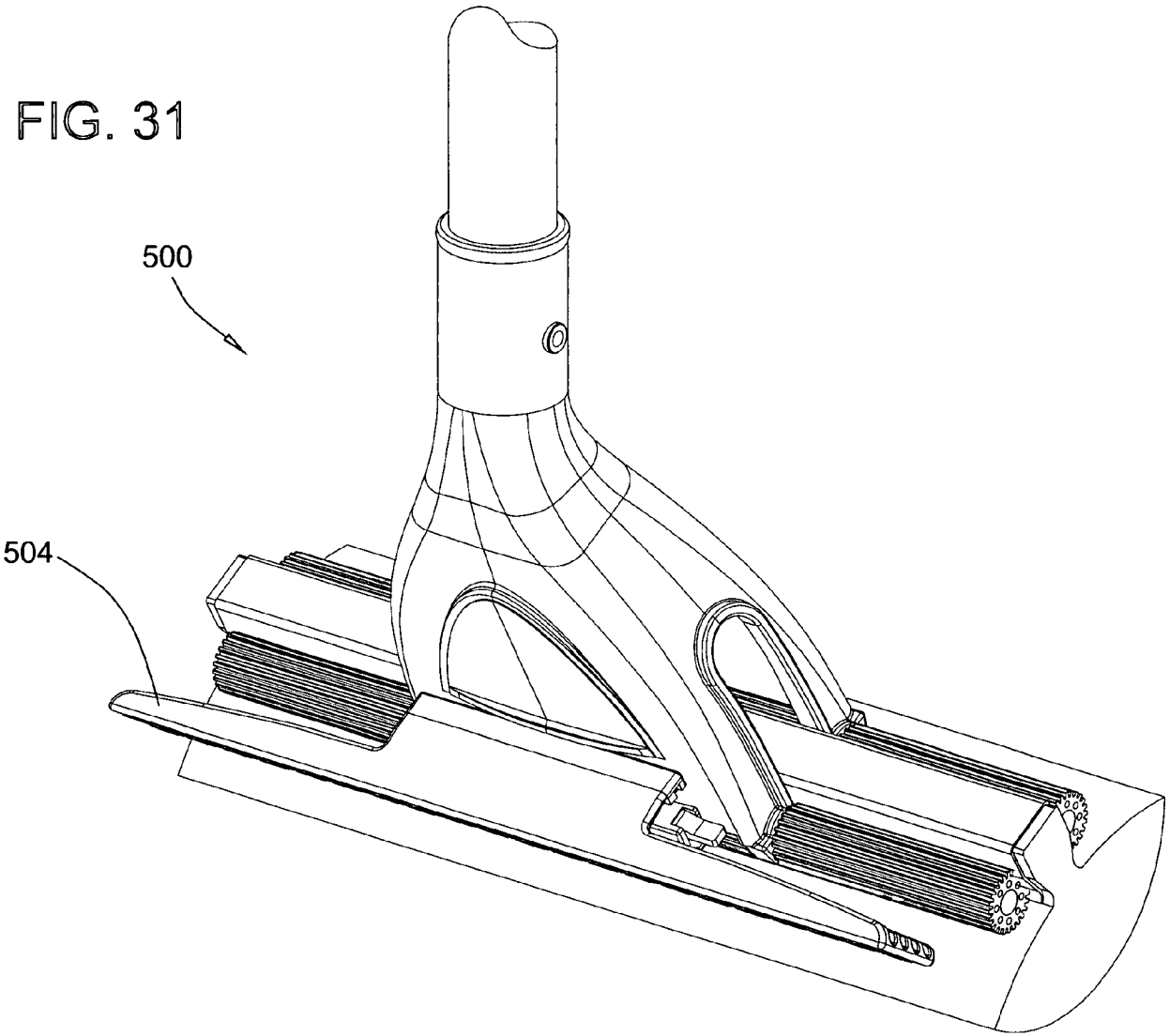
FIG. 31 is fragmentary perspective view of another embodiment of a cleaning implement according to the present invention having the scrubber attachment of FIG. 30 removably mounted thereto.

Referring to FIGS. 30 and 31, another embodiment of a scrubber attachment 504 useful in connection with the present invention is shown. The scrubber 504 includes a felt strip 506 mounted to the cleaning side 506 thereof rather than bristles. The felt strip can be constructed from a material that can be used to help remove scuff marks from surfaces, especially wood floors. The scrubber attachment 504 of FIG. 30 is similar in other respects to the scrubber attachment 104 of FIG. 1. In other embodiments, the strip of material can be made from a material that is more abrasive than the sponge material of the mop head. Referring to FIG. 31, a cleaning implement 500 having the scrubber attachment of FIG. 30 mounted thereto is shown. The cleaning implement 500 of FIG. 30 can be similar in other respects to the cleaning implement 100 of FIG. 1.

Figure 32:
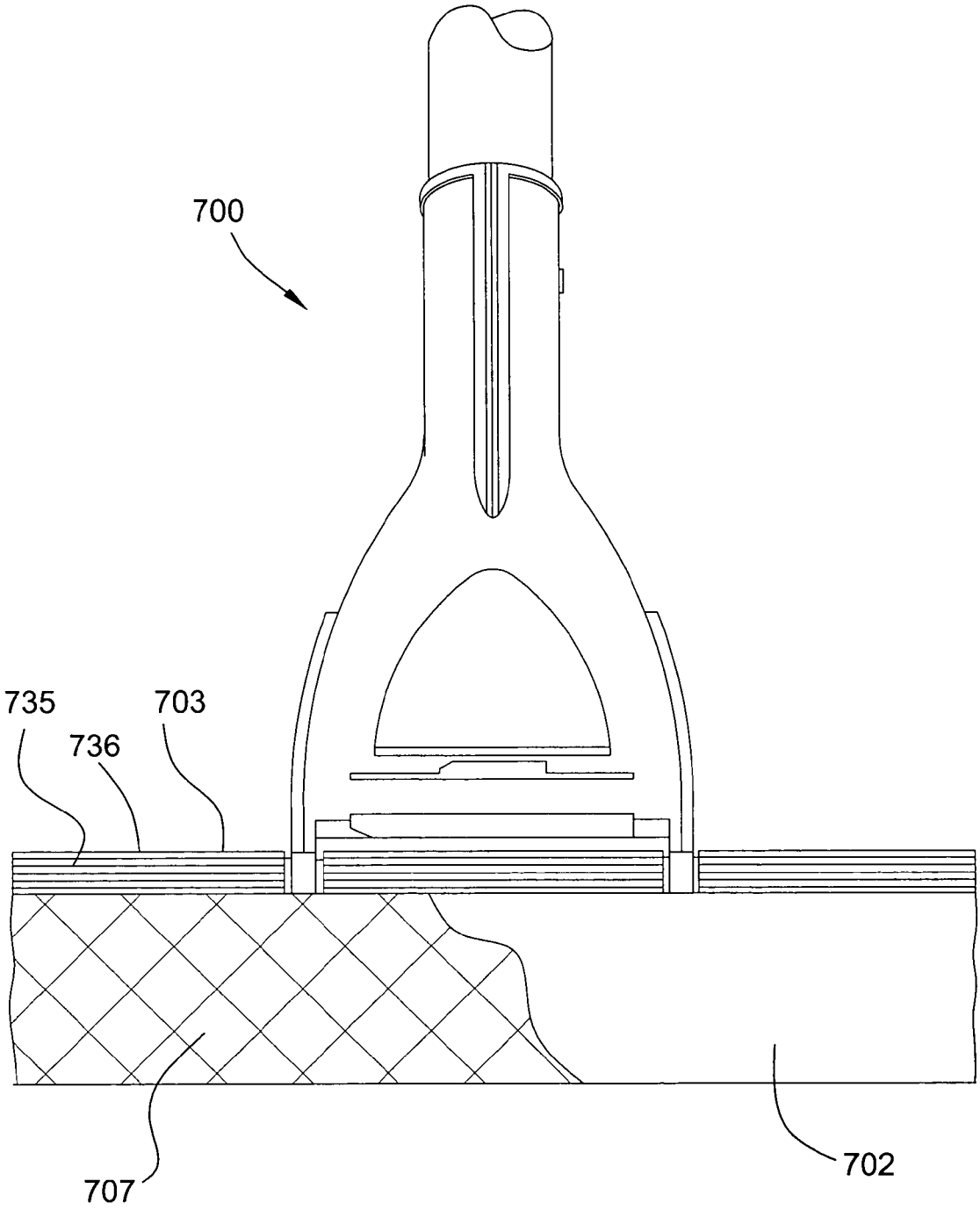
FIG. 32 is a fragmentary, front elevational view of another embodiment of a cleaning implement according to the present invention having an electrostatic dust cloth, partially cut away, removably mounted thereto.
Figure 33:
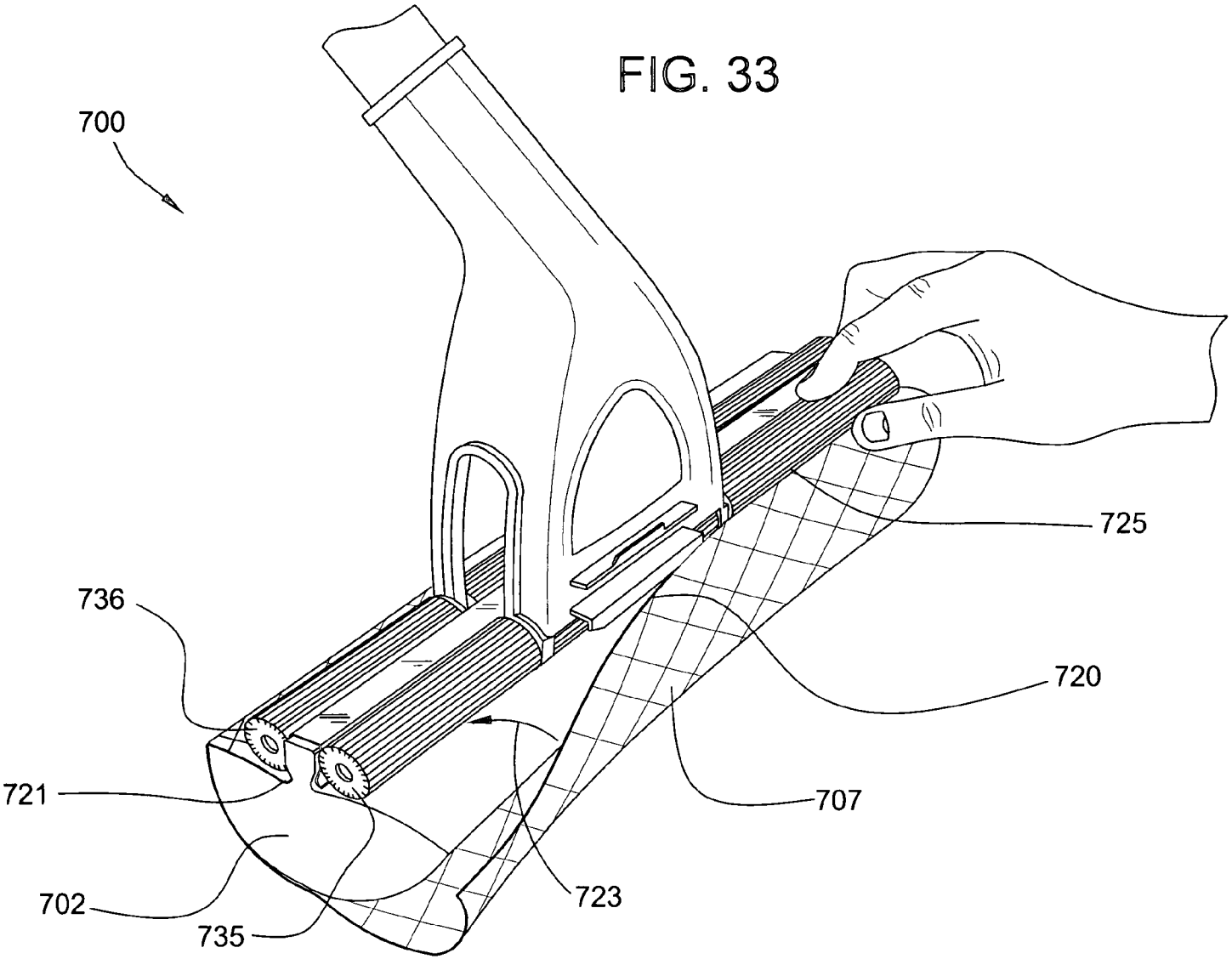
FIG. 33 is a fragmentary perspective view of the cleaning implement of FIG. 32, showing the electrostatic dust cloth partially mounted thereto.

Referring to FIGS. 32 and 33, another embodiment of a cleaning implement 700 is shown. The cleaning implement 700 includes a mop head 702 and a cleaning cloth 707 mounted to the mop head 702. The cleaning cloth 707 is mounted to the mop head 702 such that the cloth overlaps the sponge material of the mop head. The cleaning cloth 707 can be retained between the mop head 702 and the wringer mechanism 703. In the illustrated embodiment, longitudinal edges 720, 721 of the cleaning cloth 707 are disposed between the bulk 715 of the mop head 702 and a respective roller 735, 736. The cleaning cloth 707 can be any suitable cloth, such as an electrostatic dust cloth, a dust cloth that has been impregnated with a chemical, a cleaning cloth that is suitable for dry cleaning by dusting and for wet cleaning with the application of a liquid, or a cleaning cloth that is impregnated with a cleaning fluid, for example.

Referring to FIG. 33, the cleaning cloth 707 is being mounted to the mop head 702. The first longitudinal edge 720 of the cleaning cloth 707 is partially inserted between the bulk of the sponge material 715 of the mop head 702 and the first roller 735. The sponge material can be resiliently movable such that a user can create a gap between the mop head 702 and the first roller 735 through which the first longitudinal edge 720 can be inserted in a mounting action 723 such that at least a portion 725 of the longitudinal edge 720 is disposed between the first roller 735 and the mop head 702 to retain the cleaning cloth 707. The second longitudinal edge 721 is shown disposed between the mop head 702 and the second roller 736 along substantially its entire length.

The components of the mop may be made of conventional materials and assembled in a conventional manner. For instance, the wringer, connector, rollers, and hanger cap preferably are made of a plastic material. The shaft preferably comprises a hollow tube made of thin gauge steel tubing. The connecting link preferably is made of steel, aluminum, or like material. Exemplary material for the mop head includes double cell polyether.

Thus, it is seen that the invention provides a cleaning implement having an angled mop head. The invention also provides a cleaning implement having an angled mop head with a scrubber attachment. In practice, a cleaning implement may include one or more of the aforementioned features, or all of said features. Other configurations are possible; for instance, the mop head ordinarily may be affixed relative to the shaft and the rollers operatively connected to the connecting link.

All references, including publications, patent applications, and patents, cited herein are hereby incorporated by reference The use of the terms "a" and "an" and "the" and similar referents in the context of describing the invention is to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended to illuminate the invention and does not pose a limitation on the scope of the invention unless otherwise claimed. No language in the specification should be construed as indicating any non-claimed element as essential to the practice of the invention.

Preferred embodiments of this invention are described herein. The scope of the appended claims should not be deemed limited by the preferred embodiment described and illustrated hereinbefore. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cleaning implement comprising:

a shaft having an operator end and a cleaning end;

a mop head comprising a liquid-absorbent member;

a wringing mechanism comprising an operator gripping portion and a wringer, the wringer being disposed at the cleaning end of the shaft, the mop head being movable relative to the wringer over a range of travel at least between a cleaning position and a plurality of wringing positions, the wringing mechanism in the wringing positions compressing at least a portion of the liquid-absorbent member whereby liquid is expellable therefrom;

a mounting track disposed on at least one of the shaft and the wringing mechanism, the mounting track including an opening end and an opposing end, the mounting track including a first rail and a second rail, the mounting track including first and second flanges depending respectively from the first and second rails, the first and second flanges being in offset relationship with each other;

a scrubber attachment removably mounted to the mounting track, the scrubber attachment having a leading end and a trailing end, the scrubber attachment having a polarity, the leading end being configured such that the scrubber attachment is mountable to the mounting track by inserting the leading end into the opening of the mounting track, and the trailing end being configured such that it cannot be inserted into the opening of the track; and wherein the scrubber attachment is removably mounted to the mounting track such that the scrubber attachment is removable therefrom without requiring the removal of another component before removing the scrubber attachment.

2. The cleaning implement according to claim 1, wherein the scrubber attachment has a first runner and a second runner, the first and second runners engageable with the first and second rails, respectively, the first and second runners being configured such that the first runner cannot mount to the second rail and the second runner cannot mount to the first rail.

3. The cleaning implement according to claim 2, wherein the scrubber attachment has first and second retaining grooves, the first and second retaining grooves being configured to engage the first and second flanges, respectively.

4. The cleaning implement according to claim 3, wherein the first flange is offset from the opening of the track such that when the scrubber attachment is moved in a mounting direction from the opening onto the track, there is range of travel wherein the second retaining groove is in retentive engagement with the flange of the second rail and the first retaining groove is disengaged from the first flange of the first rail.

5. The cleaning implement according to claim 2, wherein the second runner has a resilient retaining finger and a stop.

6. The cleaning implement according to claim 5, wherein the retaining finger includes a shoulder which is in retentive engagement with the second rail when the scrubber attachment is in a mounted position, and the second rail includes a notch for accommodating at least a portion of the resilient finger when the scrubber attachment is in mounted position.

7. The cleaning implement according to claim 1, wherein the leading end is configured such that it cannot be inserted into the opposing end of the track.

8. The cleaning implement according to claim 7, wherein the trailing end is configured such that it cannot be inserted into the opposing end of the track.

9. The cleaning implement according to claim 1, wherein the trailing end is configured such that it cannot be inserted into the opposing end of the track.

10. The cleaning implement according to claim 1, wherein the operator end and the cleaning end of the shaft define a longitudinal axis therebetween, the mop head includes a connecting side and a cleaning side, the connecting side and the cleaning side defining a mop head axis therebetween, the mop head axis being disposed at an oblique mop angle with respect to the longitudinal axis of the shaft, the scrubber attachment including a cleaning side and a connecting side, the cleaning side of the scrubber attachment defining a scrubbing plane, the scrubber attachment having a scrubber axis perpendicular to the scrubbing plane of the cleaning side, the scrubber axis being disposed at an oblique scrubber angle with respect to said longitudinal axis of said shaft.

11. The cleaning implement according to claim 10, wherein the scrubber angle is substantially the same as the mop angle.

12. The cleaning implement according to claim 1, wherein the scrubber attachment includes a connecting side and a cleaning side, the connecting side and the cleaning side each defining a substantially planar surface, the planar surfaces being in non-parallel relationship with respect to each other.

13. The cleaning implement according to claim 1, wherein the shaft has a hollow portion and a slot communicating therewith, and the wringing mechanism includes a connecting link, the connecting link being connected to the operator gripping handle and one of the mop head and the wringer thereby permitting relative movement of the wringer and the mop head upon movement of the operator gripping handle, the connecting link extending through the slot and having at least a portion thereof being disposed within the hollow portion of the shaft.

14. The cleaning implement according to claim 1, wherein the wringer includes a pair of rollers and a channel body for supporting the rollers in spaced relationship with each other such that a channel is defined therebetween.

15. The cleaning implement according to claim 14, wherein the mounting track is mounted to the channel body.

16. The cleaning implement according to claim 1, wherein the scrubber attachment includes a plurality of bristles.

17. The cleaning implement according to claim 1, wherein the scrubber attachment includes a felt strip.

18. The cleaning implement according to claim 1, wherein the mop head includes a retaining clip, the retaining clip including a plurality of nubs, the nubs being configured to inhibit movement of the mop head from a cleaning position toward an extended position.

19. The cleaning implement according to claim 1, wherein the mop head includes a layer of material, overlaying the liquid-absorbent member.

20. The cleaning implement according to claim 19, wherein the layer of material comprises a reticulated material.

21. The cleaning implement according to claim 20, wherein the mop head includes a plurality of valleys wherein the liquid-absorbent member is exposed, and a plurality of lands in alternating relationship with the valleys, the lands having the layer of material disposed thereon.

22. A cleaning implement comprising:

a shaft having an operator end and a cleaning end, the operator end and the cleaning end defining a longitudinal axis;

a mop head comprising a liquid-absorbent member;

a wringing mechanism comprising an operator gripping portion and a wringer, the wringer being disposed at the cleaning end of the shaft, the mop head being movable relative to the wringer over a range of travel at least between a cleaning position and a plurality of wringing positions, the wringing mechanism in the wringing positions compressing at least a portion of the liquid-absorbent member whereby liquid is expellable therefrom; and a cleaning cloth removably mounted to the mop head such that the cleaning cloth overlaps at least a portion of the liquid-absorbent member, the cleaning cloth having opposed longitudinal edges that extend in a longitudinal direction of the mop head when the cleaning cloth is mounted on the mop head, the cleaning cloth being held on the mop head by a portion of the cleaning cloth being retained between the mop head and the wringing mechanism and the cleaning cloth being removable from the mop head with the cleaning cloth completely intact by releasing the portion of the cleaning cloth from between the mop head and the wringing mechanism.

23. The cleaning implement according to claim 22, wherein the wringing mechanism includes a pair of rollers and a channel body, the channel body mounted to the cleaning end of the shaft, the rollers supported by the channel body, the cleaning cloth including a pair of longitudinal edges, one of the longitudinal edges disposed between the liquid-absorbent member and the first roller, and the other of the longitudinal edges disposed between the liquid-absorbent member and the second roller.

24. The cleaning implement according to claim 22, wherein the cleaning cloth is an electrostatic dust cloth.

25. The cleaning implement according to claim 22, wherein the cleaning cloth is capable of being used for wet or dry cleaning.

26. The cleaning implement according to claim 22, wherein the cleaning cloth is a dust cloth impregnated with a chemical.

27. A cleaning implement comprising:

a shaft having an operator end and a cleaning end;

a mop head comprising a liquid-absorbent member, the mop head being disposed adjacent the cleaning end of the shaft;

a wringing mechanism comprising an operator gripping portion and a wringer, the wringer being disposed adjacent the cleaning end of the shaft, the mop head being movable relative to the wringer over a range of travel at least between a cleaning position and a plurality of wringing positions, the wringing mechanism in the wringing positions compressing at least a portion of the liquid-absorbent member whereby liquid is expellable therefrom; and a scrubber attachment mounted to the wringing mechanism via a mounting mechanism having a resiliently flexible retaining finger, the scrubber attachment mountable to the wringing mechanism by relative movement of the scrubber attachment with respect to the wringing mechanism in a mounting direction, the retaining finger configured to move into an engaged position so as to engage an opening once the scrubber attachment is in a mounted position such that the scrubber attachment is prevented from moving in a removal direction opposite to the mounting direction, the retaining finger being arranged between opposing ends of a connecting side of the scrubber attachment when the scrubber attachment is in the mounted position, the retaining finger being resiliently movable to a disengaged position to permit the scrubber attachment to move in the removal direction from the mounted position and the retaining finger being movable back into the engaged position when the scrubber attachment or a second scrubber attachment is moved back into the mounted position on the mounting mechanism.

28. The cleaning implement according to claim 27, wherein the mounting mechanism is configured to mount the scrubber attachment only when the scrubber attachment is in only a single predetermined orientation.

29. The cleaning implement according to claim 27, wherein the wringer includes a pair of rollers and a channel body for supporting the rollers in spaced relationship with each other such that a channel is defined therebetween, and the scrubber attachment is mounted to the channel body.

30. The cleaning implement according to claim 29, wherein the channel body includes a track, and the mounting mechanism is configured to mount the scrubber attachment to the track only when the scrubber attachment is in a predetermined orientation.

31. The cleaning implement according to claim 30, wherein the track of the channel body includes first and second rails, and the mounting mechanism of the scrubber attachment includes first and second runners, the first and second runners configured to respectively engage the first and second rails, the retaining finger mounted to one of the runners and the rails.

32. The cleaning implement according to claim 31 wherein the retaining finger is mounted to the second runner.

33. The cleaning implement according to claim 32, wherein the retaining finger includes a shoulder which is in retentive engagement with the second rail when the scrubber attachment is in the mounted position, and the second rail includes a notch for accommodating at least a portion of the retaining finger when the scrubber attachment is in the mounted position.

34. The cleaning implement according to claim 32, wherein the retaining finger is disposed at a first end of the second runner and a stop is disposed at a second end thereof, the retaining finger configured to engage the second rail once the scrubber attachment is in the mounted position such that the scrubber attachment is prevented from moving in the removal direction, the stop configured to prevent the second runner from moving further in the mounting direction once the scrubber attachment is in the mounted position.

35. The cleaning implement according to claim 34, wherein the retaining finger includes a shoulder, the shoulder engaging the second rail when the scrubber attachment is in the mounted position, the retaining finger movable to disengage the shoulder from the second rail to allow the scrubber attachment to be movable in the removal direction.

36. The cleaning implement according to claim 31, wherein the first rail of the channel body has a flange, the first runner of the scrubber attachment has a pair of ribs defining a retaining groove therebetween, the retaining groove configured to accommodate the flange when the scrubber attachment is mounted to the track to retentively engage the scrubber attachment and the channel body.

37. The cleaning implement according to claim 36, wherein the second rail of the channel body has a flange, the scrubber attachment has a guide rib, the second runner of the scrubber attachment and the guide rib defining a second retaining groove therebetween, the second retaining groove configured to accommodate the flange of the second rail when the scrubber attachment is mounted to the track to retentively engage the scrubber attachment and the channel body.

38. The cleaning implement according to claim 27, wherein the retaining finger includes a terminal barbed portion.

39. The cleaning implement according to claim 38, wherein the terminal barbed portion includes a terminal beveled surface, a second beveled surface, and a shoulder.

40. The cleaning implement according to claim 38, wherein the mounting mechanism includes a stop.

41. A cleaning implement comprising:

a shaft having an operator end and a cleaning end, the operator end and the cleaning end defining a longitudinal axis therebetween;

a mop head comprising a liquid-absorbent member;

a wringing mechanism comprising an operator gripping portion and a wringer, the wringer being disposed at the cleaning end of the shaft, the mop head being movable relative to the wringer over a range of travel at least between a cleaning position and a plurality of wringing positions, the wringing mechanism in the wringing positions compressing at least a portion of the liquid-absorbent member whereby liquid is expellable therefrom;

a mounting track disposed on at least one of the shaft and the wringing mechanism, the mounting track including an opening end and an opposing end, the opening end and the opposing end defining a mounting track axis therebetween, the mounting track axis being in transverse relationship with the longitudinal axis of the shaft, the mounting track including a first rail and a second rail, the mounting track including first and second flanges depending respectively from the first and second rails, the first flange having a shorter length than the second flange; and a scrubber attachment removably mounted to the mounting track, the scrubber attachment having a leading end and a trailing end, the scrubber attachment having a polarity, the leading end being configured such that the scrubber attachment is mountable to the mounting track by inserting the leading end into the opening of the mounting track, and the trailing end being configured such that it cannot be inserted into the opening of the track wherein the scrubber attachment includes a connecting side and a cleaning side, the connecting side and the cleaning side each defining a substantially planar surface, the planar surfaces being in non-parallel relationship with respect to each other.

* * * * *